US007520772B2

(12) United States Patent
Hanks

(10) Patent No.: US 7,520,772 B2
(45) Date of Patent: Apr. 21, 2009

(54) COMPRESSION SNAP ELECTRICAL CONNECTOR

(75) Inventor: Rip Hanks, Gulf Breeze, FL (US)

(73) Assignee: Centerpin Technology, Inc., Pensacola, FL (US)

( * ) Notice: Subject to any disclaimer, the term of this patent is extended or adjusted under 35 U.S.C. 154(b) by 0 days.

(21) Appl. No.: 11/737,495

(22) Filed: Apr. 19, 2007

(65) Prior Publication Data

US 2007/0202735 A1 Aug. 30, 2007

Related U.S. Application Data

(63) Continuation-in-part of application No. 11/420,646, filed on May 26, 2006, now Pat. No. 7,226,308.

(51) Int. Cl.
*H01R 4/24* (2006.01)

(52) U.S. Cl. ..... 439/427; 439/393

(58) Field of Classification Search ..... 439/427–429, 439/393, 401, 784, 805, 807
See application file for complete search history.

(56) References Cited

U.S. PATENT DOCUMENTS

| | | | | |
|---|---|---|---|---|
| 3,249,908 | A | 5/1966 | Fuller et al. | |
| 3,304,447 | A | 2/1967 | Lindt | |
| 5,228,875 | A | 7/1993 | Swenson, Sr. | |
| 5,695,369 | A | 12/1997 | Swenson, Sr. | |
| 5,868,589 | A | 2/1999 | Swenson, Sr. | |
| 5,934,943 | A | 8/1999 | McCarthy | |
| 6,126,491 | A * | 10/2000 | McCarthy | 439/695 |
| 6,241,553 | B1 * | 6/2001 | Hsia | 439/578 |
| 6,358,103 | B1 | 3/2002 | Tomasino | |
| 6,488,548 | B1 | 12/2002 | Tomasino | |
| 6,494,753 | B1 | 12/2002 | Tomasino | |
| 6,568,952 | B1 | 5/2003 | Tomasino | |
| 6,692,313 | B1 | 2/2004 | Tomasino | |
| 6,695,653 | B1 | 2/2004 | Tomasino | |
| 6,796,829 | B1 | 9/2004 | McCarthy | |
| 6,796,853 | B1 | 9/2004 | Tomasino | |
| 6,814,630 | B1 | 11/2004 | Tomasino | |
| 6,830,491 | B1 | 12/2004 | Tomasino | |
| 6,851,966 | B1 | 2/2005 | Tomasino | |
| 6,857,895 | B2 | 2/2005 | Korte et al. | |
| 6,866,550 | B1 | 3/2005 | Tomasino | |
| 6,890,208 | B2 | 5/2005 | McCarthy | |
| 2003/0207610 | A1 | 11/2003 | Lindemann et al. | |
| 2004/0192121 | A1 | 9/2004 | Tomasino | |

* cited by examiner

*Primary Examiner*—Hien Vu
(74) *Attorney, Agent, or Firm*—Momkus McCluskey, LLC; Jefferson Perkins

(57) ABSTRACT

An electrical connector has a connector body with a bore and a cap through which a stranded insulated conductor is threaded. A ridge in the external surface of the cap engages with at least one groove in the bore to secure the conductor in place. Preferably, there are at least two such grooves in the bore at different axial positions, and the cap is axially advanced from one such groove to another one farther inside the bore to effect full physical and electrical connection. Surface pairs make up each such ridge and groove, with the area of one of the surface pairs being much greater than the other one of the surface pairs. The connector may have multiple bores and caps, and embodiments are provided for coaxial conductors.

20 Claims, 28 Drawing Sheets

COMPRESSION SNAP ELECTRICAL CONNECTOR

RELATED APPLICATIONS

This application is a continuation in part of copending U.S. patent application Ser. No. 11/420,646 filed 26 May 2006, owned by the assignee hereof. The disclosure of that application is fully incorporated herein by reference.

BACKGROUND OF THE INVENTION

There are many electrical connectors which are known from the published prior art or the marketplace. These connectors seek to connect together electrical conductors without soldering and often without the use of tools. Connectors exist for multistranded insulated wires or cables as well as coaxial cables.

Several such connectors are sold by Swenco Products, Inc. under the mark POSI-LOCK®. Many of these connectors are illustrated in U.S. Pat. Nos. 5,228,875; 5,868,589; 6,358,103 B1; 6,494,753 B1; 6,568,952 B1; 6,692,313 B1; 6,695,653 B1; 6,814,630 B1; 6,830,491 B1; 6,851,966 B1; 6,866,550 B1; and U.S. Patent Application Pub. No. US2004/0192121 A1. These connectors usually require stripping the insulation off of a terminal portion of the wire, and all are connected together by twisting a cap onto a connector body. But helical twisting motions of a multistranded conductor as it is being connected often torsionally stress the metallic strands sought to be connected, resulting in a less than optimum physical and electrical connection. A need therefore persists for connectors which can make a secure electrical connection to a multistranded insulated electrical conductor without twisting one part onto another.

SUMMARY OF THE INVENTION

According to one aspect of the invention, an electrical connector is provided which includes a body with a bore having an axis, and a cap through which a multistranded electrical conductor is threaded. A sidewall of the bore body has a first groove spaced inwardly from an open end of the bore, and at least a second groove spaced inwardly in the bore from the first groove, diameters of these grooves in general being greater than the diameter of the bore sidewall from which they radially outwardly extend. A ridge in the cap is adapted to be received in either of the first and second grooves in the bore of the body. In order to complete a connection of the conductor to a conductive element disposed in the bore of the body, the cap and conductor are advanced into the bore from the first groove until the cap ridge is seated in the second groove.

Preferably, each of the grooves has a first surface and a second surface formed axially outwardly of the first surface, the first and second surfaces formed to be generally at an angle to the axis. The area of the first surface should be substantially greater than the area of the second surface. Concomitantly, the ridge of the cap is preferred to have a leading surface and a trailing surface formed axially outwardly from the trailing surface, with the area of the leading surface being substantially greater than the area of the trailing surface.

Preferably, either or both of the first and second grooves are constituted by a shoulder or step at which the interior diameter of the bore increases, and a beveled surface extending from this step axially inwardly into the bore of the body and extending radially inwardly. In many embodiments the beveled surface is a surface of rotation and in axial section can be straight, convexly curved or concavely curved, among other possible shapes. The ridge of the cap is formed in somewhat complementary fashion, such that a beveled surface of the ridge on the cap engages one of the beveled surfaces of the first and second grooves.

In a further aspect of the invention, an electrical connector includes a body with a bore and a cap. At least one groove is formed in the sidewall of the bore to be spaced axially inwardly from an open end of the bore. The groove has a second internal diameter which is larger than a first internal diameter taken across the bore entrance. A conductive element of the connector body extends from a bottom of the bore and has a beveled surface that, as one proceeds down the bore, slopes radially outwardly. A ridge in the cap is adapted to fit into or register with the groove in the body bore.

An inner bore of the cap has a beveled surface which engages with the beveled surface of the conductive element. An insulated multistranded conductor has insulation removed from an end portion thereof. This conductor is threaded through the cap. Connection is made by advancing the cap down the bore until a ridge on the cap snaps into or registers with the groove on the bore. When this happens, conductive strands of the stripped end of the conductor will be compressed between the inner beveled surface of the cap bore and the beveled surface on the conductive element in the body bore.

In one variation of this embodiment, the interior of the cap includes a constriction beyond which only the stripped conductor can extend, and a set of threads or rings axially outwardly adjacent this restriction for threaded or other sealing engagement to the insulation. In another variation that is alternative or cumulative to this, an o-ring in the cap bore seals to the insulation of the conductor.

The present invention has application to connectors which connect to single insulated conductors as well as multiple insulated conductors. Multiple bores in a connector body can be arranged in parallel to each other, each bore receiving a respective insulated conductor for connection. The connector body can have all of the bores on one side of its body, or alternatively can have one or more conductor-receiving bores on opposed sides of its body. In many multiple-conductor embodiments, individual caps are provided for respective conductors and these are received into respective bores. In other multiple-conductor embodiments, at least one multiple-conductor cap is provided which has a plurality of cavities therethrough, each of which accepts a respective conductor. The multiple-conductor cap can have parallel shafts surrounding and defining respective ones of the cavities, and these shafts are received in respective bores in the connector body. A sealing elastomeric o-ring can be provided to seal each shaft to the connector body, or alternatively one o-ring can be provided which surrounds all of the cap shafts and seals between an enlargement of the multiple conductor cap and a face of the connector body.

The multiple bores can each have more than two grooves, and the caps which fit into them can have more than two ridges. Axial profiles of the surfaces making up these grooves and ridges can be straight or other than straight, such as convexly curved or concavely curved, as long as the grooves and ridges are made up of surface pairs in which the area of one such surface in the pairs is substantially greater than the area of the other member of the surface pair. An array of multiple bores in a connector body does not have to be two-dimensional but can instead be three-dimensional.

The grooves and ridges can be reversed, such that the ridges project from a generally cylindrical surface of a connector body and the grooves are formed in a sidewall of a cap cavity. In such an embodiment, the body can have one or more such ridges and the cap should have two or more grooves which fit to them. This reversed embodiment has particular application in connecting to insulated coaxial conductors, in which the connector body further has a plurality of elongate piercing fingers designed to pierce through the external layer of insulation into a conductive sheath of the coaxial conductor. In one coax embodiment, the connector body has a central bore for receiving a stripped central conductor of the coaxial conductor. In another coax embodiment, the connector body has, axially outwardly extending from a face thereof, a hollow prong adapted to pierce the insulation surrounding the central conductor and to electrically connect to that central conductor. A sloping surface inside of the cap cavity cams the fingers into engagement with the conductor one the cap is compressed onto the body.

In one embodiment, a connector for a coaxial conductor further has an elastomeric gasket adapted to closely fit to the external insulation of the coaxial conductor. When the cap is compressed to be snap-fit to the second, axially inward ridge on the connector body, the gasket is compressed between the shoulders of the piercing fingers and an axially outward end wall of the cap, sealing the cap to the external surface of the conductor.

BRIEF DESCRIPTION OF THE DRAWINGS

Further aspects of the invention and their advantages can be discerned in the following detailed description, in which like characters denote like parts and in which.

DETAILED DESCRIPTION

Figure 1A:
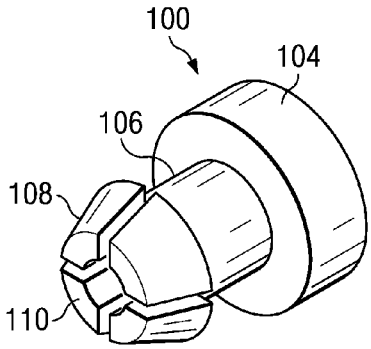
FIGS. 1A-1D are isometric, top, front and axial sectional views of a cap or plug according to a first embodiment of the invention.
Figure 1B:
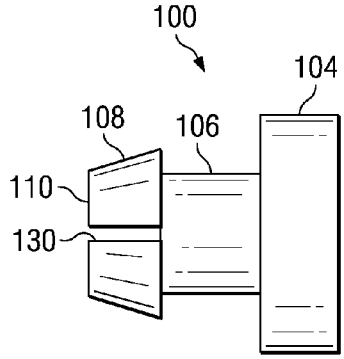
Figure 1C:
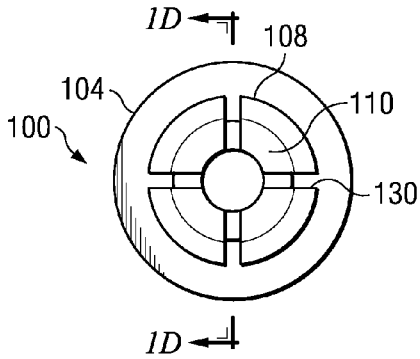
Figure 1D:
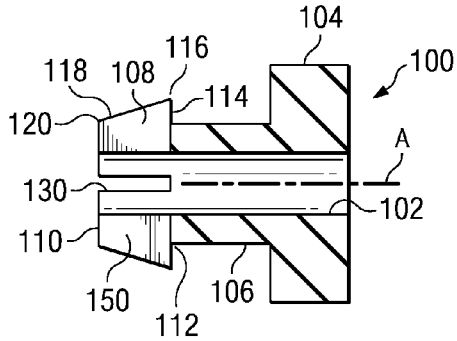

Referring first to FIGS. 1A-1D and 2A-2D, in a first embodiment of the invention, a connector body 200 has a generally cylindrical external shape. Throughout these illustrated embodiments, it should be understood that the body 200 and its analogs can be plastic, metal, or any other suitable material; body 200 does not have to be conductive. The body 200 has a bore 202 with an open end 204 and a generally cylindrical interior sidewall 206 which terminates in a bottom 208. The body 200 and the bore 202 are conveniently formed around an axis A. The body 200 preferably should be formed of a material that is somewhat elastic, so that it will stretch slightly and snap back during stages of insertion of the cap and conductor into the bore 202, as will be later described. But the body 200 should not be so elastic that the connection will easily fail because of the cap being pulled back out of the connector body.

The bottom 208 of the bore 202 has a central hole 210 through which is inserted a conductive element 212, in the illustrated case a pin connector. The conductive element 212 alternatively could be a spade connector, a battery terminal or any other shape adapted for connection to further electrical apparatus. In the illustrated embodiment, the conductive element 212 has a flange or base 214 which tightly fits to the sidewall 206 and is adapted to rest on the bottom 208 of the bore. In an alternative embodiment the conductive element 212 could have one or more radial processes meant to be in-molded into the back wall 216 of the body 200, as will be shown in other embodiments herein. The conductive element 212 has an upstanding and coaxial pin or prong 218 which extends from the bottom 208 axially outwardly toward the bore open end 204. The pin 218 preferably is beveled or pointed at its free end 220 so as to be adapted to impale the conductive strands of a multistranded insulated conductor 222, seen in FIGS. 2E and 2F. In this embodiment, the diameter of pin 218 is relatively small and, after its beveled or sharpened point 220, stays substantially constant until it joins with base or flange 214.

While bore 202 is generally cylindrical (or alternatively prismatic), it is not completely so. Importantly, the bore 202 has at least one, and in this embodiment two, grooves 224 and 226. The groove 224 is axially spaced away from the bore opening 204 and, at its greatest extent, has an inner diameter perpendicular to the axis A which is greater than the inner diameter across the opening 204. In the illustrated embodiment, the groove 224 is formed by a step or shoulder 228, at which the groove 224 begins to depart from the general coaxial and cylindrical surface 206 of the bore 202. The step or shoulder 228 extends from a point 229 radially outwardly by a predetermined distance to a radially outward end 230 thereof. Starting at point or end 230, a beveled surface 232 proceeds axially inwardly and radially inwardly for a predetermined distance until it terminates at point or end 234. In the illustrated embodiment, the shoulder 228 and the beveled surface 232 are surfaces of rotation around axis A. A diameter taken across the axis at point 234 is significantly less than the diameter taken at point 230. In this embodiment, the groove 224 is formed by a flat surface 228 and a frustoconical surface 232. The groove 224, which as will be explained acts as a detent or positioner for a cap, can take a form different from that shown; for example it can instead be formed by one or more convex or concave curved surfaces. Preferably, and regardless of the axial profile of the surfaces 228 and 232, axially inward surface 232 should have an area which is substantially greater than an area of axially outward surface 228.

In the illustrated embodiment, the first groove 224 is accompanied by a second groove 226 that is spaced down the bore 202 from groove 224, thus defining distinct axial positions in the bore 202. In this embodiment, the surfaces forming groove 226 are immediately adjacent those forming groove 224, although it could be otherwise. A step or shoulder 236 begins at point 234 and proceeds radially outwardly by a predetermined distance until point 238, at which it ends and a beveled surface 240 begins. The beveled surface 240 proceeds axially inwardly (that is, toward bottom 208) and radially inwardly (toward axis A) until point or end 242. At point 242, in the illustrated embodiment the generally cylindrical surface 206 resumes and continues to the bottom 208. A diameter taken across the axis at point 238 is greater than a diameter taken across the axis at point 242. Like groove 224, groove 226 in the illustrated embodiment is formed by two surfaces of rotation around axis A, a flat surface 236 disposed in a plane orthogonal to the axis, and a frustoconical surface 240 adjoining surface 236. But groove 226 could be formed by other surfaces. Like groove 224, groove 226 acts as a detent or positioning means for the connector cap and other surfaces (such as curved ones) could instead be provided for this purpose. To ensure that pull-out is more difficult than completing the connection to begin with, the area of surface 240 should be preselected to be much greater than that of surface 236. Further, while in this illustrated embodiment grooves 224 and 226 are shown to be continuous or endless, and circumferentially extend around the entirety of the connector bore sidewall 206, grooves 224 and 226 could instead be discontinuous or even be made up of disconnected portions, and still be able to perform their cap-detenting or positioning function. In a similar fashion, the ridge on cap 100 (described below) could be chosen to be discontinuous rather than circumferentially endless.

The cap 100 for this embodiment is illustrated in FIGS. 1A-1D. The cap 100 has a bore or through-hole 102 adapted to receive the multistranded conductor 222 (seen in FIGS. 2E and 2F). In this illustrated embodiment, most of the surfaces of cap 100 are formed as surfaces of rotation around the axis A. An outer axial end 104 of the illustrated embodiment is enlarged, such that its outer diameter across the axis is greater than the inner diameter across connector body bore entrance 204 (see, e.g., FIG. 2D). The cap 100 has a central portion 106 of cylindrical shape whose external diameter is less than that of outer axial end 104, and which is also less than the respective inner diameters taken at points 229 and 234 inside bore 202 of connector body 200. The cap 100 further has an enlargement or ridge 108 formed somewhere on its external surface, in this illustrated embodiment adjacent its axial inner end 110. Ridge 108 has an outer diameter at its greatest extent which is greater than the inner diameter of the bore entrance 204.

In this embodiment, the ridge 108 is formed by two surfaces of rotation which are roughly complementary to the surfaces forming grooves 224 and 226. Starting at point 112 on the generally cylindrical middle section 106, a flat, annular surface 114 projects radially and orthogonally outwardly to a point 116. Point 116 marks the end of a frustoconical surface 118, which extends axially inwardly (that is, toward the bottom 208 of bore 202 when the cap 100 is being used) and radially inwardly to a point 120, which in this embodiment the same radial distance away from the axis A as is surface 106. In the illustrated embodiment point 120 happens to be a portion of inner axial end 110 of cap 100, but the ridge-creating surfaces 114, 118 can be positioned anywhere on the exterior surface of cap 100 (with commensurate adjustments of the positions of grooves 224, 226).

The angle of bevel of frustoconical surface 118 does not have to be the same as the angles of connector body frustoconical surfaces 232, 240, and in one commercial embodiment they in fact are different. The first frustoconical surface 232 can be selected to somewhat loosely receive the cap surface 118. On the other hand, the second connector body frustoconical surface 240 can be selected to induce a camming effect on the surface 118; as will be later described herein, the surface 240 can be relatively steep so as to force the leaves of a split surface 118 radially inwardly to grip the conductor insulation. While the illustrated axial profiles of ridge-creating surfaces 114, 118 are straight, they can be chosen to be otherwise, such as convexly or concavely curved. Surface pairs 114, 118 should be chosen such that the area of surface 118 greatly exceeds that of surface 114.

The cap 100 can be formed of plastic, metal or any other suitable material. It preferably is somewhat elastic, that is, it will deform and return to its initial shape after the deforming force is removed. This elasticity permits the cap to "snap" to either of the grooves 224, 226 after being forced beyond body bore sidewall constrictions in front of them. Conveniently, both cap 100 and connector body 200 can be injection-molded using a thermoplastic or thermosetting polymer.

In this embodiment, the cap 100 has at least one, and more preferably a plurality (such as four) slits or openings 130 which extend from the inner axial end 110 of cap 100 axially outwardly for a predetermined distance. In the illustrated embodiment, the slits 130 are each arranged to lie in planes including axis A, but they don't need to be; preferably, they should extend at least roughly longitudinally. In the illustrated embodiment, the slits 130 extend for the same distance as, and are limited to, the frustoconical surface 118, but conceptually the positioning of slits 130 and of ridge 108 are entirely independent of each other, as they do separate jobs. The function of ridge 108 is to index the cap 100 to one of the connector body grooves 224, 226; the function of the slits 130 is to permit the portion of cap 100 adjacent inner axial end 110 to compress inwardly. In the illustrated embodiment the slits 130 are rectangular in shape but they could also be triangular or take another shape whereby more material is removed the farther one proceeds inwardly on the axis A.

Figure 2A:
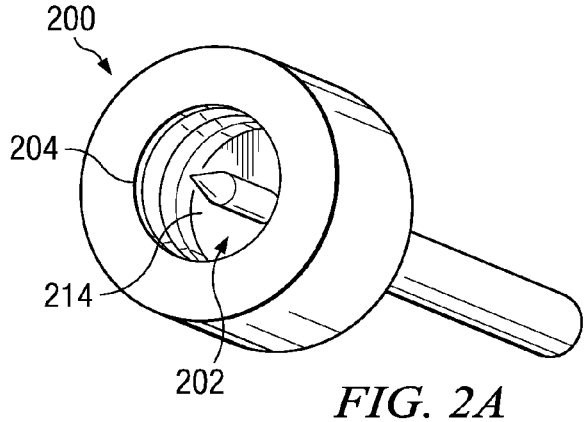
FIGS. 2A-2D are isometric, side, front and axial sectional views of a connector body for use with the cap shown in FIGS. 1A-1D.
Figure 2B:
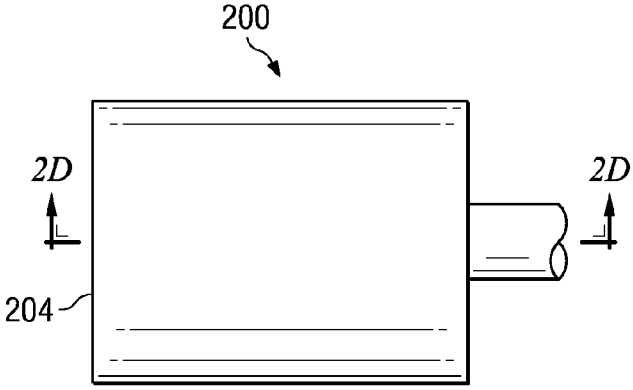
Figure 2C:
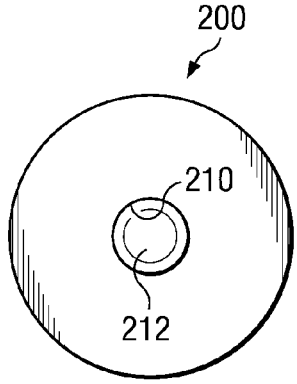
Figure 2D:
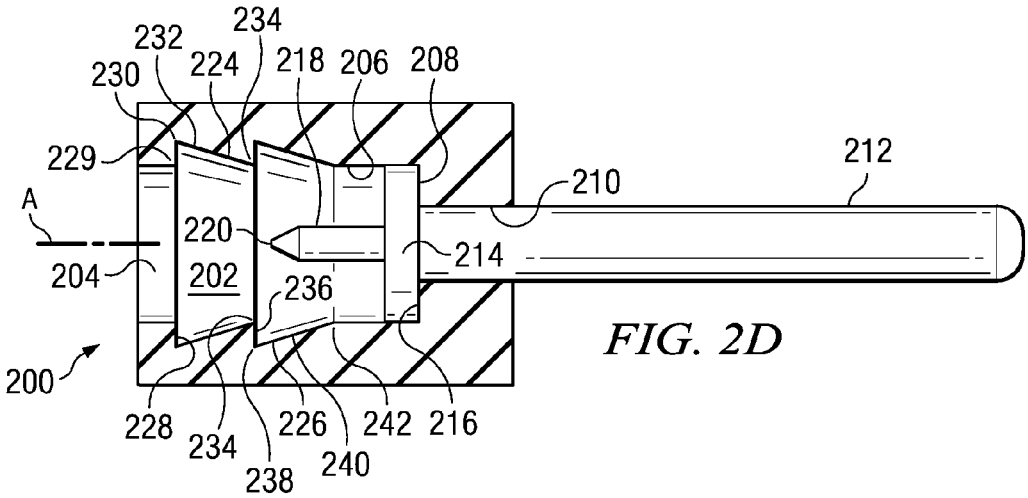
Figure 2E:
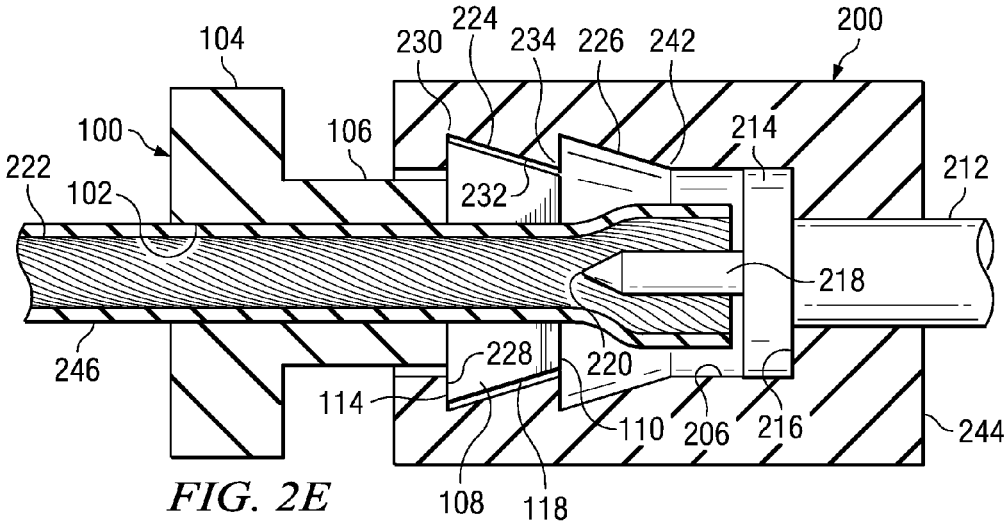
FIGS. 2E and 2F are axial sectional views of the cap and connector introduced in FIGS. 1A-2D, showing two successive stages in the connection of a multistranded conductor.
Figure 2F:
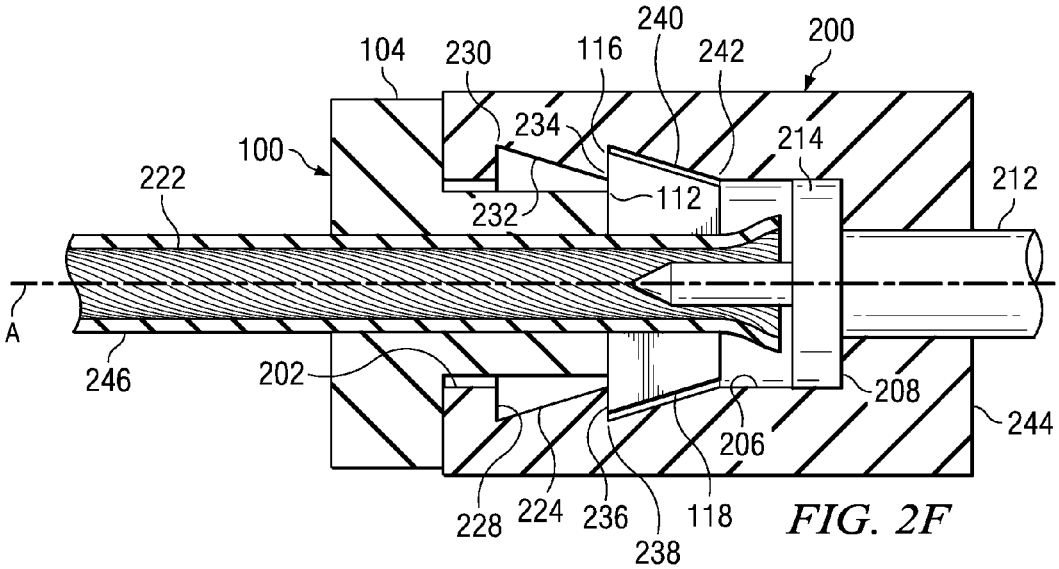

FIGS. 2E and 2F illustrate the operation of the slit-cap embodiment of the invention introduced by FIGS. 1A-1D and 2A-2D. Prior to the time shown in FIG. 2E, a multistranded insulated conductor 222 is inserted through the bore of cap 100 and is impaled on prong 218. The outside jacket 246 of the insulated conductor 222 may be marked at measured intervals which would allow the user to know when the conductor has been inserted by a correct length, instead of assuming that the conductor has been pushed in far enough because it feels bottomed out. The markings preferably would occur in pairs: a first mark would show where the end of the conductor should be cut, and a second mark, at a predetermined distance away from the first, would show the amount of conductor to be inserted into the connector. In one embodiment, the cap-connector combination 100, 200 is provided to the end user as a single unit, and in this instance the conductor 222 is inserted through the cap bore 102 while the cap 100 is in the position shown, in which the cap ridge 108 is detented to the first groove 224 in the connector body 200. In another embodiment, the conductor 222 is inserted into the bore 202 prior to the insertion of cap 100 into same.

The cap 100 is then advanced inwardly along axis A from groove 224 to groove 226. The ridge 108 will seat into or snap into place inside groove 226 and will thus indicate to the user that the cap 100 has been pushed down the bore 202 far enough. Forcing the cap 100 further into bore 202 from first groove 224 could, in some embodiments, be done manually; in other embodiments and particularly where a permanent connection is wanted that will exhibit a large amount of strain relief, a plier (not shown), preferably one with a stop to prevent overcompression, may be used to compress ends 104, 244 toward each other until ridge 108 of the cap 100 is seated in the groove 226 of the bore 202.

As this is being done, the frustoconical surface 118 is forced radially inwardly, such that that portion of the internal cap sidewall between the slits 130 will grip the insulation 246 of the conductor 222. The frustoconical surface 118 is cammed inwardly by being forced against frustoconical surface 240 of the second groove 226. The resultant gripping by cap 100 of the conductor 222 aids in strengthening the physical connection. In another embodiment (not shown), a further beveled surface inside the body bore 202 may coact with the slit end 110 of cap 100, while ridge 108 may be placed at a more axially outward position on the exterior surface of cap 100. The position of detenting of indexing grooves 224, 226 would also be more axially outward and frustoconical surface 240 would have a detenting function, but would no longer have a cap end-compressing or camming function.

Figure 3:
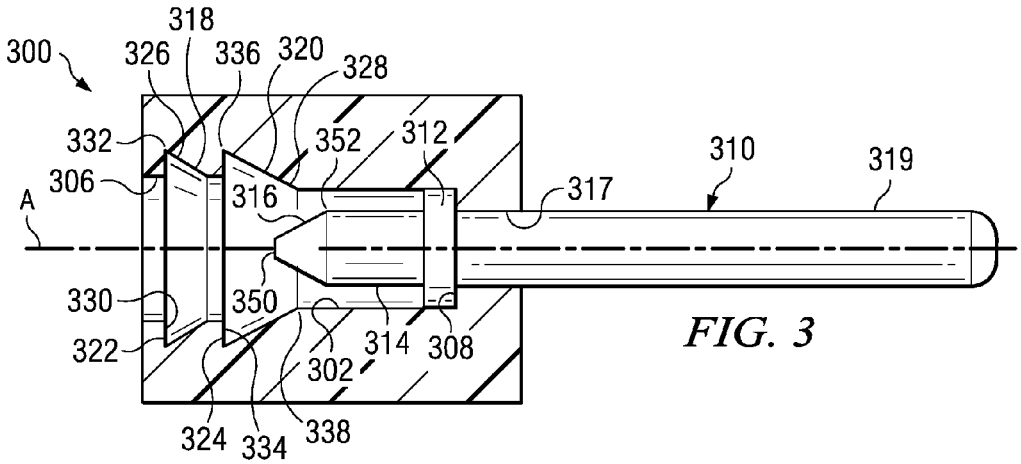
FIG. 3 is an axial sectional view of a connector or terminal body according to a second embodiment of the invention.

FIGS. 3 and 4A-4D illustrate an embodiment alternative to the "split-cap" embodiment shown in FIGS. 1A-1D and 2A-2F. In FIG. 3, a connector body 300 has a generally cylindrical exterior and a generally cylindrical bore 302, which extends from an axially outward opening 306 to a bottom 308. As before, a conductive element 310 has a base 312 which fits tightly within bore 302 and is seated on bore bottom 308. A prong or pin 314 of conductive element 310 has a reduced diameter and extends into the bore in an axially outward direction. But this prong 314 is terminated in a conical or frustoconical surface 316 that extends between respective outer and inner axial margins or ends 350, 352 thereof. The conductive element 310 extends through a central hole 317 in the bottom 308 and may, for example, terminate as the illustrated jack or pin 319. The connector body 300 (which doesn't have to be conductive) also has two grooves 318, 320 at different axial positions within bore 302. The grooves 318, 320 are formed in this illustrated embodiment by radially and orthogonally extending annular surfaces 322, 324 and adjacent frustoconical surfaces 326, 328, respectively. As in other embodiments the grooves 318, 320 could be formed by surfaces other than those shown, such as ones which are other than straight in axial profile (e.g. convexly or concavely curved). Regardless of particular shape, surface pairs 322, 326; 324, 328 should be chosen such that the area of surface 326 is substantially greater than the area of surface 322, and such that the area of surface 328 is substantially greater than the area of surface 324.

The outer opening 306 has a first inner diameter until point 330, from which annular surface 322 proceeds radially outwardly until point 332. The frustoconical surface 326 extends from point 332 radially and axially inwardly to a point or locus 334. In this illustrated embodiment, the two grooves 318, 320 are formed to adjoin each other, so locus 334 also forms an inner end of annular surface 324. Annular surface 324 extends radially and orthogonally outwardly to locus 336. The second frustoconical surface 328 extends from locus 336 radially and axially inwardly to point or locus 338. The rest of the bore 302 takes a constant diameter as one proceeds inwardly from point 338; the diameter of bore 302 in this innermost section is smaller than a diameter taken at opening 306, as the opening 306 is adapted to receive an insulated multistranded conductor 222, while the inner section of bore 302 is only meant to receive the stripped strands 340 of the conductor 222 (see FIG. 4C).

Figure 4A:
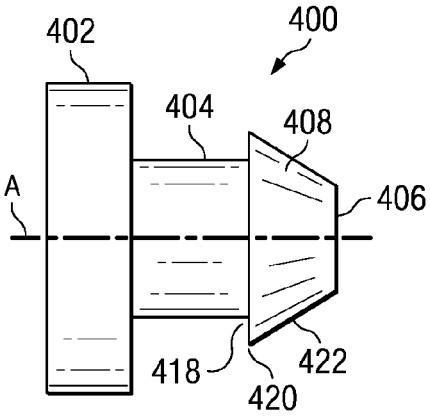
FIGS. 4A and 4B are side and axial sectional views of a cap or plug which is adapted for use with the connector body shown in FIG. 3.
Figure 4B:
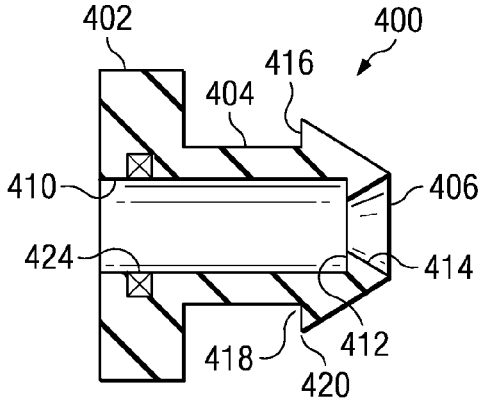

The cap 400 for this embodiment is shown in FIGS. 4A and 4B. Cap 400 has an enlarged axial outer end 402, a middle section 404 and an axial inner end 406 with (in this embodiment) an adjoining ridge 408. A substantially cylindrical inner bore 410 begins at end 402 and proceeds through middle section 404, until it terminates at an internal constriction or shoulder 412. From shoulder 412, a beveled surface 414 extends radially outwardly and axially inwardly until axial inner end 406 of cap 400. It is not necessary that beveled surface 414 in cap bore 410 be at the inner axial end 406 of cap 400; surface 414 could instead be recessed by a terminal cylindrical bore (not shown) that would join surface 414 to the inner end 406 of the cap.

Further, ridge 408 in the illustrated embodiment adjoins the axial inner end 406, but this could be chosen otherwise. As in the previously described embodiments, the function of the ridge 408 is to detent or register the cap 400 at least one, and preferably at one of at least two, separate axial positions inside of the bore 302 of the connector body 300; the ridge 408 could be moved to any location on the external surface of the cap 400 as may be convenient, with the positions of grooves 318, 320 being changed commensurately.

In this embodiment the ridge 408 is formed by the junction of two surfaces of rotation around axis A: an annular surface 416 which lies in a plane orthogonal to the axis A, and which extends from a point or locus 418 on the middle section 404, to a point or locus 420 radially outward therefrom. From point 420, a frustoconical surface 422 extends radially and axially inwardly until its termination at end 406. The ridge 408 could instead be formed by other surfaces, such as curved ones. The surface pair 416, 422 should at least roughly match in mirror image the surface pairs making up the grooves 318, 320, and should in any event be chosen such that the area of surface 422 is substantially greater than the area of surface 416.

This illustrated embodiment also includes an o-ring 424 located in the axial outer end 402 of cap 400, so as to seal to the insulation of the connected electrical conductor. The o-ring can take the form of a toroidal elastomeric ring seated in a groove on the inner bore 410 of the cap, or alternatively could be an integral, injection-molded portion of the cap that is formed before or after the remainder of the cap 400, as would occur in a double-shot injection molding process. The o-ring 424 (which instead may be square or rectangular in cross section) may be positioned at various positions along the bore 410, any of which will perform the function of sealing the cap to the conductor insulation 246 (see FIGS. 4C and 4D). This and other embodiments may in addition or in substitution be furnished with an o-ring 440 which rides on surface 404 and which will be compressed between cap enlargement 402 and the outer axial end face 442 of connector body 300 when the cap 400 is fully inserted therein. The o-rings 424, 440 or analogous structures may be provided with any other embodiment of the invention, including the other embodiments described herein or illustrated in the appended drawings.

Figure 4C:
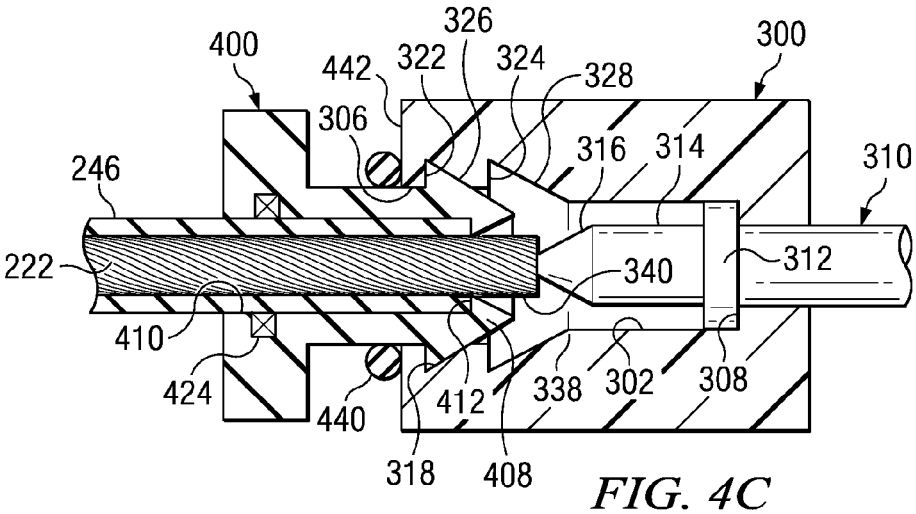
FIGS. 4C and 4D are axial sectional views of the cap and connector body shown in FIGS. 3, 4A and 4B, showing stages in connecting to a multistranded electrical conductor.
Figure 4D:
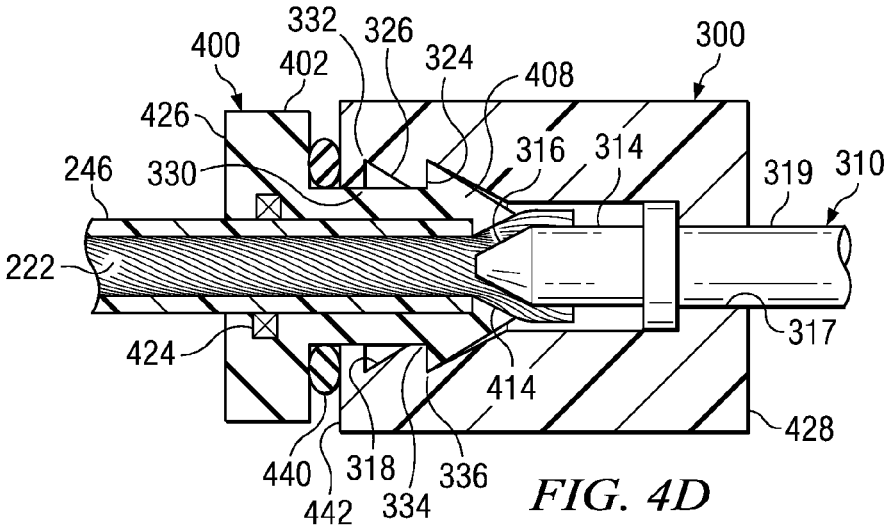

The operation of this embodiment is shown in FIGS. 4C and 4D. A multistranded insulated conductor 222 has its external insulation 246 stripped for a predetermined length from its end. The predetermined length can be given in user instructions. Alternatively, the invention may be provided in kit form with the conductor to be connected, the latter being marked on the external surface of its insulation 246 to show how far the insulation should be stripped. In another alternative, the conductor 222 may come pre-stripped, or a special insulation stripping tool (not shown) may be provided that will strip only a predetermined terminal portion of the insulation off of the end of the conductor.

The conductor 222 is then inserted into the bore 410 of the cap 400, past the o-ring 424, until the end of its insulation 246 abuts the internal shoulder 412. In the illustrated embodiment, the connector and the cap come to the user preassembled to each other, wherein the ridge 408 is registered with first groove 318 prior to the insertion of the stripped conductor 222 therein. After the conductor 222 is advanced into the bore 410 until it reaches shoulder 412, the cap 400 and the conductor 222 are advanced together further down the bore, until the ridge 408 "snaps" to or registers or seats with the second groove 320. In one embodiment, this could be done manually, but more force can be applied more precisely with a plier-like tool (not shown) which would compress end surface 426 of cap 400 and opposing end surface 428 of the connector body 300 until a stop in the plier is reached. When the ridge 408 is registered to the inner groove 408, the stripped strands 340 will spread around the frustoconical end surface 316 of the prong 314, so as to be wedged between the outwardly beveled surface 316 and the inwardly beveled surface 414 of the cap 400. In this embodiment, it is desirable that the outwardly beveled surface 316 and the inwardly beveled surface 414 be shaped to be mating surfaces to each other. The precise shape can be different from that shown, so long as both are altered concomitantly; for example, surfaces 414, 316 can be curved surfaces, with one being convex and the other concave, or vice versa.

Figure 5A:
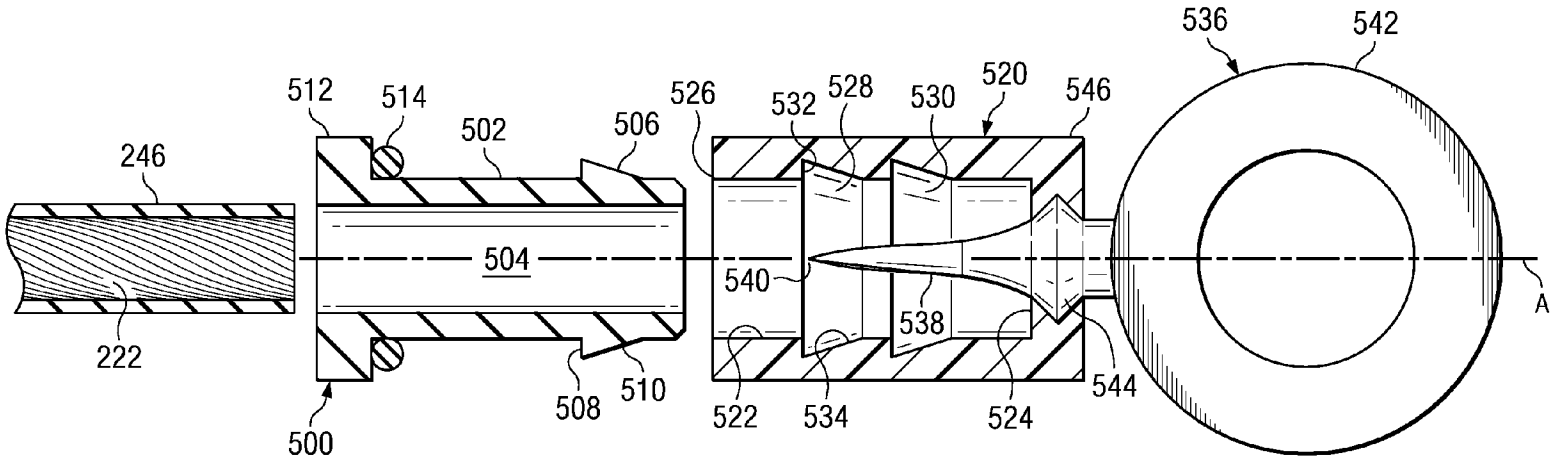
FIG. 5A is an axial sectional view of a cap and connector body according to a third embodiment of the invention, shown with an end of an insulated multistranded conductor to be connected.
Figure 5B:
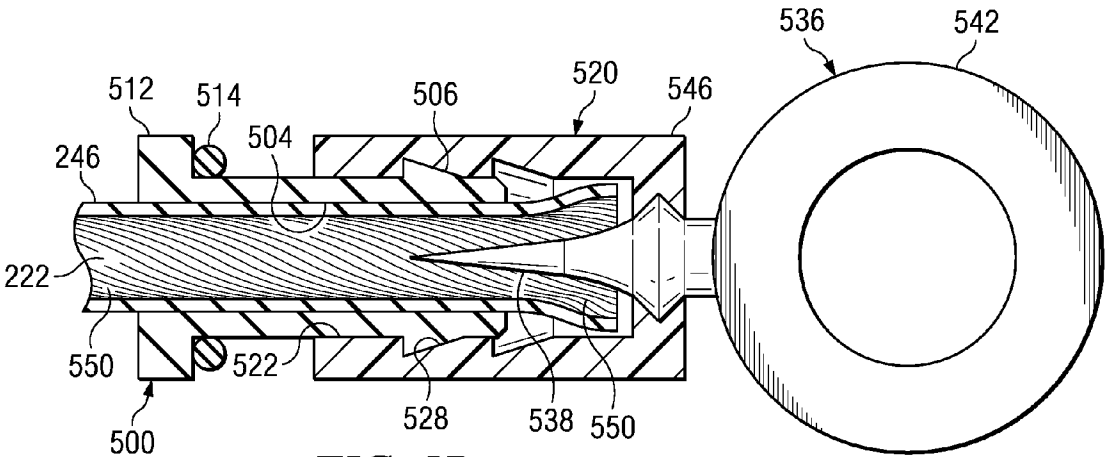
FIGS. 5B and 5C are axial sectional views of the cap, connector body and conductor shown in FIG. 5A, showing successive stages in making a connection to the end of the conductor.
Figure 5C:
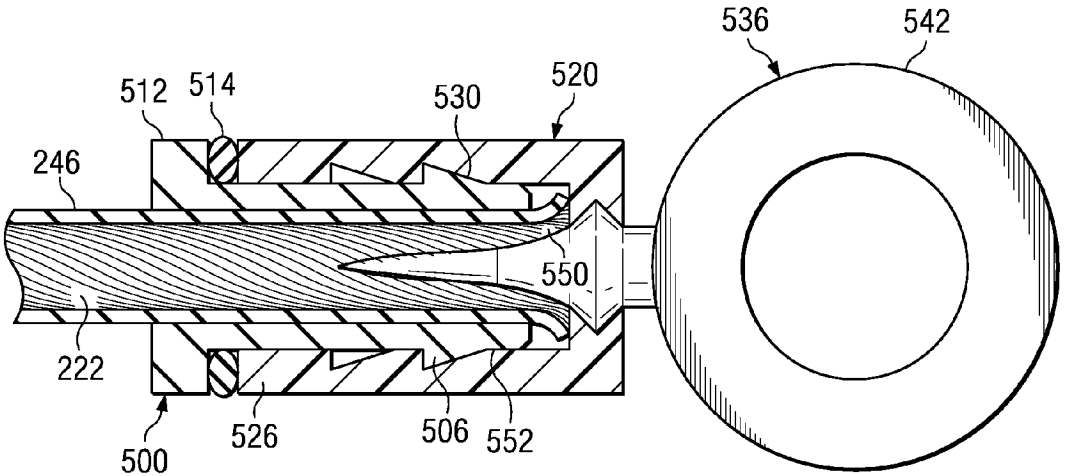

FIGS. 5A-5C show another embodiment of this invention. A cap 500 has a generally cylindrical external sidewall 502 and a cylindrical inner sidewall 504, the latter sized to receive a multistranded conductor 222. A preferably circumferential ridge 506 is formed by an upstanding annular surface 508 and a forward and inward-sloping frustoconical surface 510. The cap 500 has an enlarged axial outer end 512. Axially inwardly from the outer end 512 is an o-ring 514 which rides on the outer sidewall 502. The ridge 506 can be formed by other surface pairs than those shown, such as ones which are convexly or concavely curved in axial profile. In any event, surface pair 508, 510 should be so specified that the area of surface 510 is substantially greater than the area of surface 508.

A connector body 520 has a generally cylindrical bore 522 that terminates in a bottom 524. The bore has an axially outer end 526 with a predetermined inner diameter that is slightly larger than that of the generally cylindrical exterior sidewall 502 of cap 500, but which is smaller than the outer diameter of ridge 506. The body 520 and/or cap 500 are preferably formed of a material having a slight elasticity, so as to allow the ridge 506 to be inserted into bore 522. While being generally cylindrical (or alternatively prismatic), the bore 522 has at least one, and preferably two, grooves 528, 530 having internal diameters which are increased from that of the general surface of bore 522, and which are each adapted to receive ridge 506 of cap 500. The topography of each groove 528, 530 should at least roughly correspond to that of ridge 506, and in the illustrated embodiment each groove 528, 530 has a radially and orthogonally outwardly extending annular surface 532, joined to a radially and axially inwardly extending frustoconical surface 534. The bore 522 is provided with a conductive element 536 which includes a prong or pin 538 that extends axially outwardly from the base 524 to a point 540. The prong 538 should be sloped radially outwardly and axially inwardly, so that its diameter at the base 524 is greater than the diameter at the tip 540. The conductive element 536 can have a battery terminal connecting structure 542 as shown, but alternatively can take any other form as may be convenient to connect to electrical or electronic apparatus, such as a pin connector or a spade. In the instance that the body 522 is molded from an insulator such as injection-molded plastic, the conductive element 536 can have projections 544 which extend into the back sidewall 546 of connector body 520.

The operation of this embodiment is shown in FIGS. 5B and 5C. FIG. 5B shows cap 500 and connector body 520 in a preassembled condition in which they are preferably provided to end users. In this condition, the cap ridge 506 is detented or registered to the first groove 528. In this condition, the conductor 222 is inserted through and beyond the internal bore 504 of the cap 500 and is impaled on the prong 538. As the conductor 222 is forced on to the widening prong 538, its insulation 246 and its conductive strands 550 are forced radially outwardly. After the conductor has been so inserted, the cap 500 is advanced axially inwardly in the body bore 522, which in some embodiments can be accomplished manually but which is preferred to be accomplished by a tool (not shown) to achieve a larger and more uniform compressive force, and which can have a stop that will not permit overcompression. The cap is advanced until the ridge 506 snaps or seats into the second, axially inward groove 530 (FIG. 5C). In this position, the sidewall 552 crushes the strands 550 and the insulation 246 between itself and the sloping surface of prong 538, providing a strong physical and electrical connection. In an embodiment alternative to that shown, the inner diameter of the cap bore 504 can be chosen to be smaller than a preselected diameter taken somewhere along the prong 538. When ridge 506 is in registry with groove 530, the o-ring 514 seals the opening between enlarged cap portion 512 and the opening 526 of the body 520.

Figure 6:
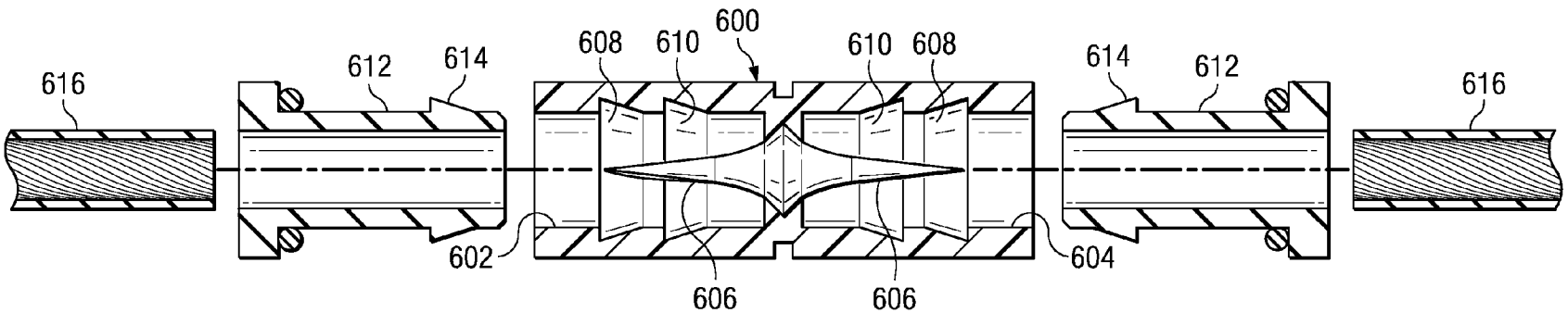
FIG. 6 is an axial sectional view of an end-to-end connector embodiment similar to the one shown in FIG. 5.

FIG. 6 shows a double-ended version of the embodiment shown in FIGS. 5A-5C. It should be understood that similar double-ended versions can be provided for the other single-ended embodiments described and illustrated herein in similar fashion. In FIG. 6, a central connector body 600 includes opposed axial bores 602, 604 each of which have a conductive prong 606, first and second circumferential grooves 608 and 610, and respective caps 612. Each cap 612 has a ridge 614 meant to be detented in one of the respective grooves 608, 610. The prongs 606 are in conductive communication with each other. This embodiment shows how the invention can be employed in a splicing rather than a terminating connector.

The number of bores 602, 604, could easily be multiplied to accept further multistranded insulated conductors 614 into a single central body (as is shown in later figures). The bores could be formed in parallel as might occur in a terminal block or wiring harness, or could be formed at angles to each other as might occur in a three-way Y-connector. Further, the bore, cap and central prong could all be made oblong, so as to accept two or more conductors side by side. In other embodiments the cap and connector body bore could be oblong, with a plurality of separately upstanding prongs positioned to pierce the ends of respective multistranded conductors.

Figure 7A:
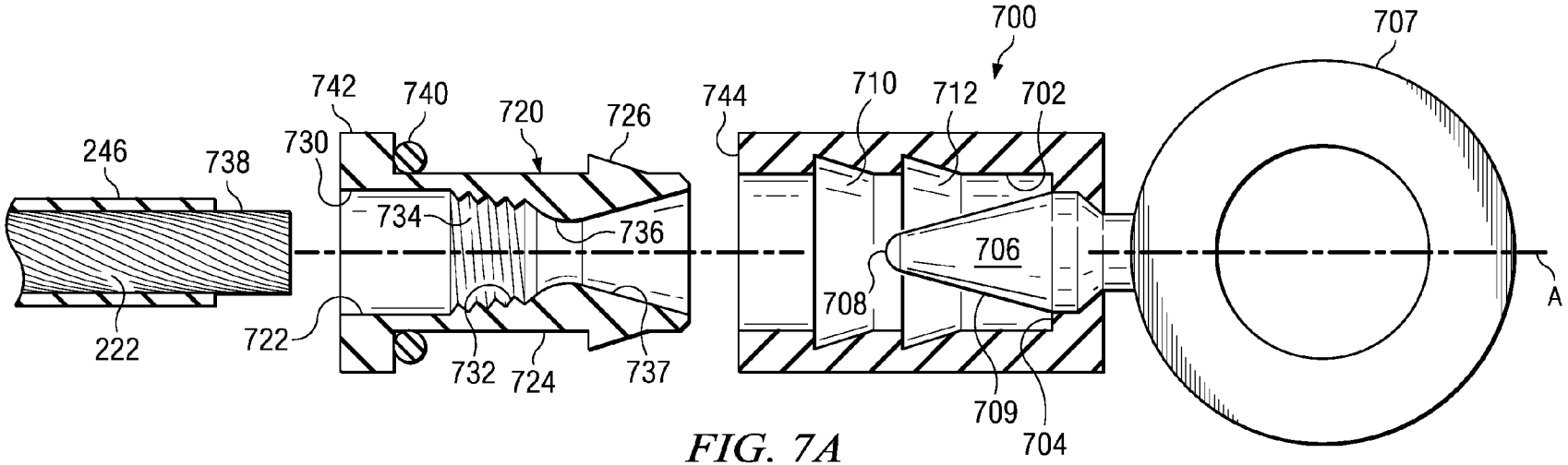
FIG. 7A is an axial sectional view of a connector body and cap according to a fifth embodiment of the invention, shown together with a multistranded insulated conductor, a terminal portion of which has had the insulation stripped away.
Figure 7B:
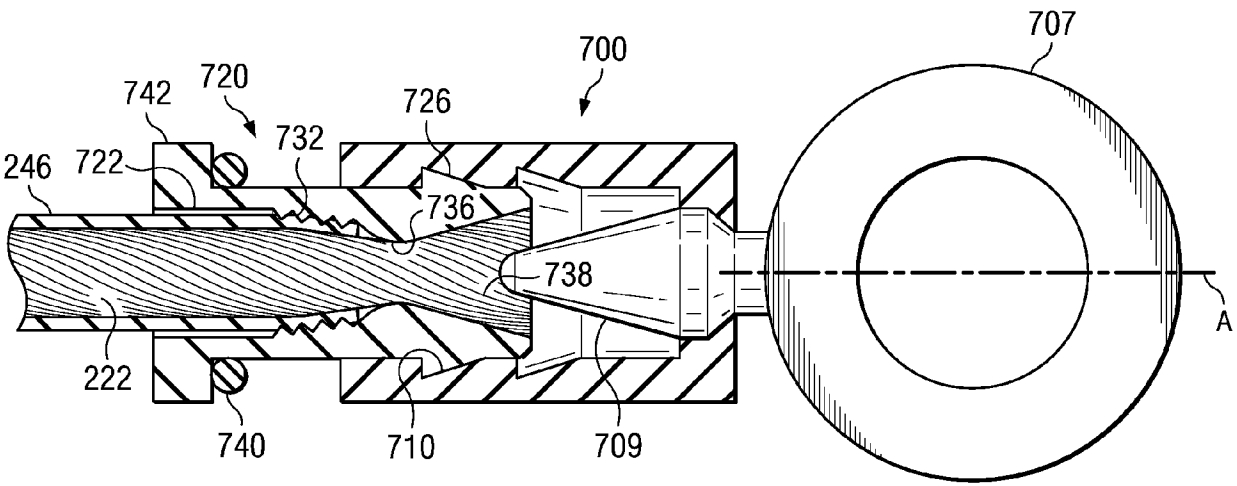
FIGS. 7B and 7C are axial sectional views of the connector body, cap and conductor shown in FIG. 7A, showing successive stages in making a connection to the conductor.
Figure 7C:
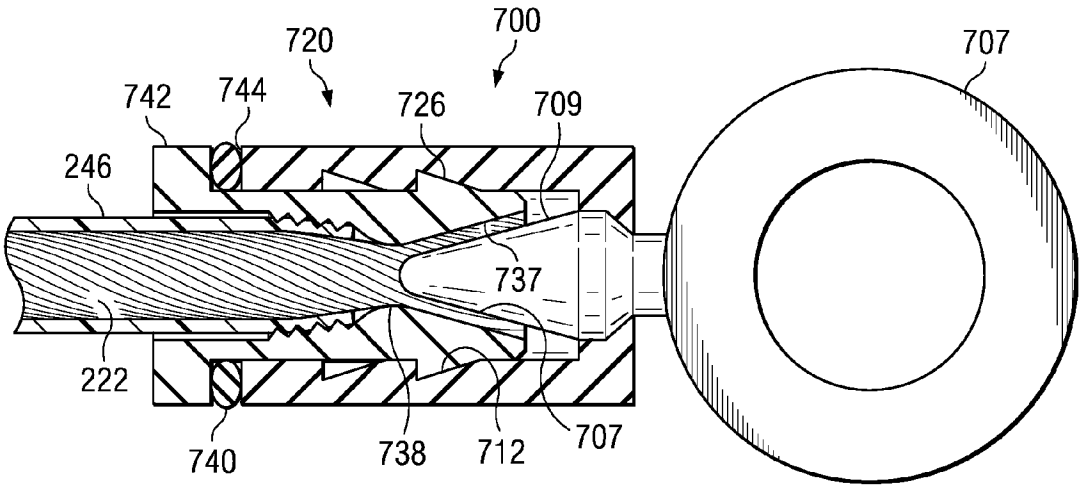

FIGS. 7A-7C illustrate a further embodiment of the invention which is a variation of the embodiment shown in FIGS. 3 and 4A-4D. In this embodiment, a connector body 700 has a generally cylindrical bore 702 with a bottom 704. A prong 706 of a conductive element 707 extends axially outwardly into the bore 702 from the bottom 704, and in this embodiment has a convexly curved surface 708 at a free end 709 thereof. While the bore 702 is generally cylindrical, it is also provided with at least one, and more preferably two, grooves 710, 712, formed at two different axial distances from the bottom 704 and the prong 706. The grooves 710, 712 are each formed by a juxtaposition of orthogonally upstanding annular surfaces and radially and axially inwardly sloping surfaces, as more fully described previously for other illustrated embodiments.

A cap 720 has an inner bore 722 and a generally cylindrical outer surface 724 which, however, includes an upstanding circumferential ridge 726. The ridge 726 is formed in such a way that it may register with either of the body bore grooves 710, 712, and is built of surfaces complementary to the surfaces making up those grooves. While the ridge and groove structures 710, 712, 726 are shown as constructed of annular and frustoconical surfaces, they can be selected otherwise, and for example can be constructed of surfaces which are concavely or convexly curved in axial profile. The leading surface of ridge 726 should be chosen to have an area which is much greater than the trailing surface thereof, and the reverse should hold true for the surfaces making up each of the grooves. The positions of grooves and ridge 710, 712, 726 can be correspondingly displaced up and down the axis A as is convenient, since those positions are chosen independently of the conductor-connecting structures radially interior to them.

The cap bore 722 has an axially outwardly disposed end 730 with an interior diameter sized to receive a multistranded conductor 222 with its insulation 246 intact. But as one proceeds axially inwardly, the diameter of bore 722 begins to constrict. Also at this point, threads 732 appear, and are provided to threadably and sealingly engage with the conductor insulation 246. In the illustrated embodiment, the threads are placed on a linearly constricting or beveled throat 734 that provides gradually increasing resistance as the insulation 246 is threaded onto it. The frustoconical disposition of the threads 732 also permits some variation in conductor outer diameter, as any within a predetermined range will be able to be sealingly connected using this embodiment. Instead of threads 732, a plurality of nonhelical, coaxial sealing rings (not shown) could be provided, and these could have a "shark tooth" profile to permit the easy insertion of insulation 246 beyond them, but make the extraction thereof in an axially outward direction more difficult.

Axially inwardly from the threads 732 is a constriction 736, which only permits the stripped conductor strands 738 to pass through it. The exterior surface of insulation 246 may be marked so that an optimal terminal portion thereof is stripped, and/or a tool may be provided for this purpose, or the conductor 222 may be provided with one end pre-stripped together with connector components 700, 720 in kit form. After constriction 736, at some point (in this illustrated embodiment, immediately) the bore will flare out again in a circumferential beveled surface 737 that corresponds in mirror image to the surface 709 of conductive element 707. The cap 720 also has a sealing o-ring 740 which is disposed axially inwardly of a cap enlargement 742 that forms cap 720's axial outer end. The o-ring 740 will sealingly engage with an axially outer end 744 of the body 700.

The operation of this embodiment is illustrated in FIGS. 7B and 7C. In FIG. 7B, a multistranded insulated conductor 222 has had its insulation 246 stripped from a predetermined terminal portion (which may be marked in advance for stripping), leaving bare conductive strands 738. The cap 720 may be provided to the end user preassembled to the body 700, as shown, with the cap detented to the first ridge 710. After stripping the conductor 222 is threaded into cap bore 722, wherein the insulation 246 is threaded onto cap threads 732. This may be accomplished by rotating the cap 720 relative to the conductor 222. Where a series of coaxial sealing rings are used instead, the conductor 222 may simply be inserted without twisting into cap bore 722 as far as it can go. When fully engaged, the stripped portion of the conductive strands 738 will extend through the throat or constriction 736.

Once the threads 732 have fully engaged the insulation 246, the cap 720 and conductor 222 are advanced together until the cap ridge 726 snaps into or seats in second groove 712 (FIG. 7C). This compression may be accomplished manually in some embodiments and may require a tool in others. In this position the conductive strands 738 are clamped between the convex beveled surface of conductive element 707 and the concave beveled surface 737 of cap 720. This makes a secure physical and electrical connection to the conductor 222. Also in this position, the o-ring 740 will be compressed between the enlarged cap portion 742 and an axial outward end surface 744 of the connector body 700.

Figure 8:
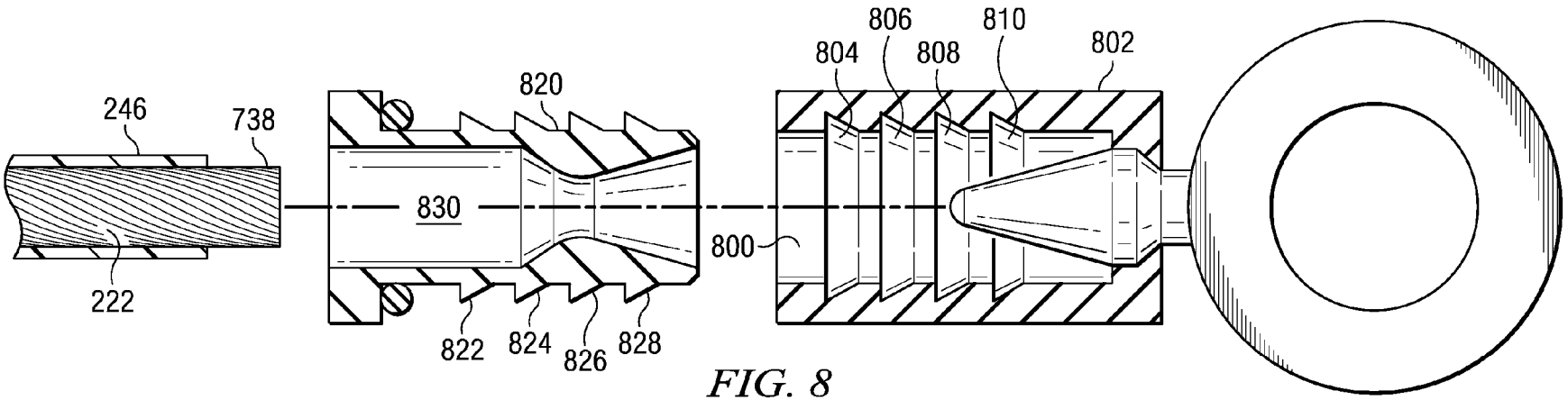
FIG. 8 is an axial sectional view of a connector body and cap according to a sixth embodiment of the invention, shown together with a multistranded insulated conductor, a terminal portion of which has had the insulation stripped away.

FIG. 8 illustrates another variation on the embodiment shown in FIGS. 3 and 4A-4D. In this embodiment, instead of just two grooves inside of a bore 800 of a connector body 802, there are multiple grooves, here shown as four such grooves 804, 806, 808 and 810 by way of example, each displaced from each other at a different axial position inside the bore 800. A cap 820 is provided with a plurality of ridges, by way of example four such ridges 822, 824, 826 and 828, each of which project radially outwardly from a general cylindrical exterior surface 830. The number of ridges on the cap 820 does not have to be the same as the number of grooves 804-810; in one embodiment (not shown), only one such ridge is provided. Each ridge 822-828 is capable of registration in one of the grooves 804-810.

This embodiment permits positioning or detenting the cap 820 at each of several axial positions inside connector body bore 800. The cap 820 may be presented to an end user as preassembled to the connector body 802, with the first ridge 828 snapped to or seated in the leading groove 804. A multistranded conductor 222, from which a terminal portion of the insulation 246 has been stripped, is inserted through the cap bore 830, as before. The cap is then compressed manually or with a tool further into the bore 800, to groove 806, 808 or even 810. The provision of several such grooves permits the connector to accept and effectively connect to a range of sizes of the conductor 222. While more than two sets of grooves 804-810 are shown as provided with an embodiment similar to that shown in FIGS. 3 and 4A-4D, more than two such grooves can also be provided in conjunction with any other embodiment of the invention.

Figure 9A:
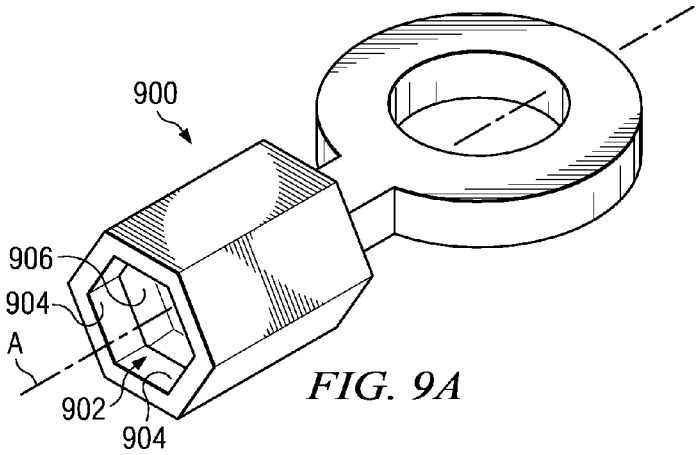
FIGS. 9A and 9B are isometric views of a connector body and cap, respectively, according to a seventh embodiment of the invention.
Figure 9B:
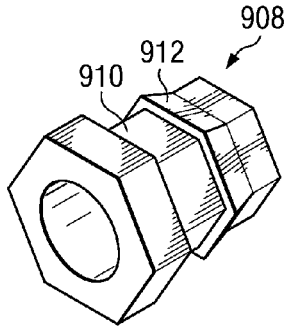

FIGS. 9A and 9B illustrate a further variation of the invention, in which a connector body 900 has a generally prismatic, rather than a generally cylindrical, bore 902. The bore or cavity 902 is shown with six sides 904 but prisms of other shapes can instead be provided, or indeed any other noncircular cross sectional shape that stays relatively constant as one proceeds down the axis A of the bore 902. Each or at least some of the sides 904 will be provided with at least one, and preferably two, grooves 906, which can have a frusto-pyramidal shape and each be formed of two planar surfaces. A cap 908 will have a generally prismatic external surface 910 which is adapted for insertion into the connector cavity 902. A preferably circumferential ridge 912, which is preferably but not mandatorily made up of another set of frustopyramidal surfaces, is adapted to register or snap into a selected one of the grooves 906. Ridge 912 and grooves 906 can be alternatively be made up of surfaces which are convexly, concavely or otherwise curved in axial profile, but in any event, a leading surface making up ridge 912 should have a surface area which is substantially greater than a trailing surface thereof, and the reverse should hold true for each of the grooves 906.

This embodiment is possible because the cap 908 fastens the conductor (not shown) in place with a straight axial movement rather than a twisting movement. Indeed, a noncylindrical embodiment such as that shown in FIGS. 9A and 9B may be preferred in those instances where torsional damage to the conductor is sought to be prevented, because the end user will be forced to insert the cap 908 into the bore 902 in an axially straight motion, and the noncircularity of the cap and the bore effectively prevent one from being twisted with respect to the other.

Figure 10A:
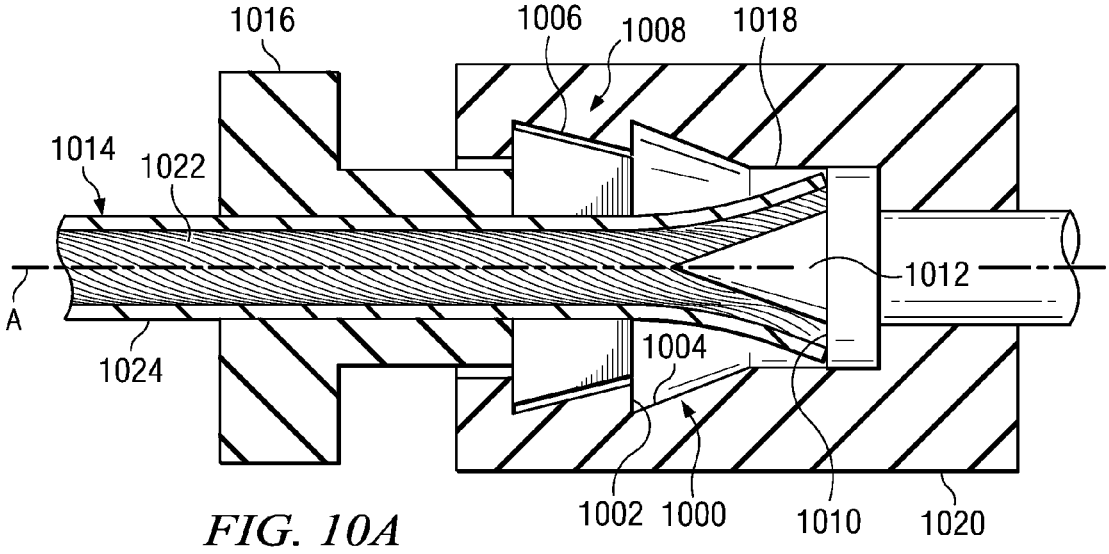
FIGS. 10A and 10B are axial sectional views of a connector body and cap according to an eighth embodiment of the invention, showing two stages in the connection to a multistranded electrical conductor.
Figure 10B:
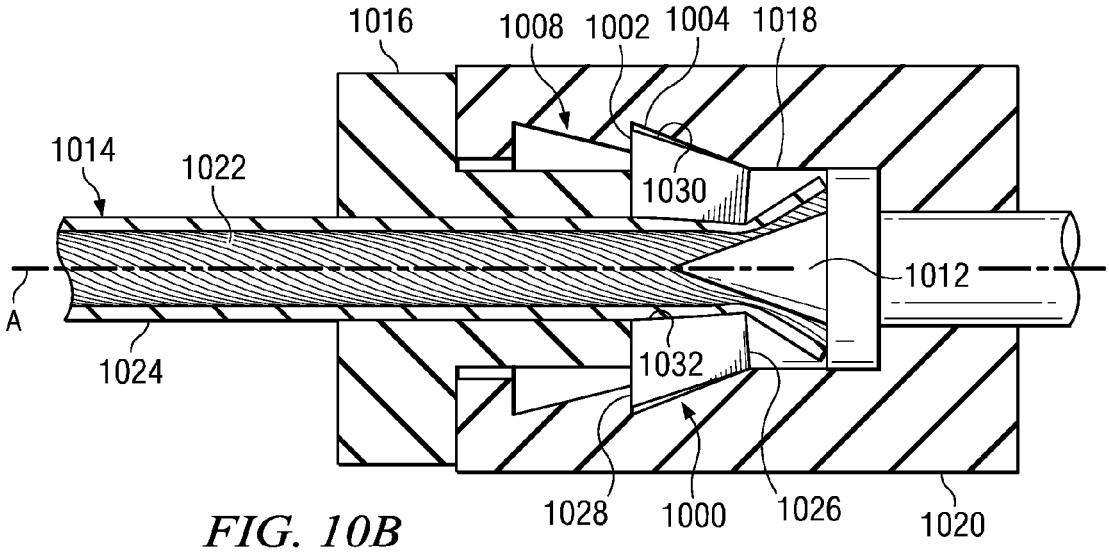

FIGS. 10A and 10B show an embodiment similar to that shown in FIGS. 1A-2F, with the following changes. The second or inner groove 1000 is formed by a straight annular surface 1002, as before, but also by a frustoconical surface 1004 that is angled more steeply than the corresponding frustoconical surface 1006 of groove 1008. That is, as one proceeds inwardly toward bore bottom 1010, points on the sloped surface 1004 approach the axis A more quickly than do corresponding points on surface 1006. The central conductive connecting element takes the form of a relatively broad-based cone 1012. In the first connection step shown in FIG. 10A, an insulated multistranded conductor 1014 is inserted through the cap 1016 and into the bore 1018 of the connector body 1020, so that the conductive strands 1022 of the conductor 1014 will be impaled on cone 1012 and will spread apart, together with insulative sheath 1024.

FIG. 10B shows the second step in making a connection. After the end of conductor 1014 has been impaled on cone 1012, the cap 1016 is advanced inwardly into the bore 1018, from the first groove 1008 to the second groove 1000. The cap 1016 has an axially inner end 1026 that has been split (similar to that shown in FIG. 1A). When the cap 1016 proceeds sufficiently down the bore 1018, the axially outward end 1028 of cap frustoconical surface 1030 will snap past the annular surface 1002. In this condition, the frustoconical surface 1030 will be cammed radially inwardly by the steep frustoconical surface 1004, causing the inner bore 1032 of the cap 1016 to compress into the conductor 1014. The inner diameter of the inner end 1026 of the cap 1016 is smaller than the base diameter of cone 1012, particularly as so cammed by connector surface 1004, so that the conductive strands 1022 and the insulation 1024 will be more firmly crushed by the interaction of cap 1016 and the central cone 1012, making for a more secure connection.

As in the other embodiments illustrated herein, the axial profiles of the surfaces making up the cap ridge and the connector body grooves 1000, 1008 can be chosen as other than straight, so long as the surface pair chosen to make up the cap ridge is such that its leading surface 1030 has an area which is substantially greater than its trailing surface, and so long as the opposite holds true for the surface pairs making up grooves 1000 and 1008.

Figure 11:
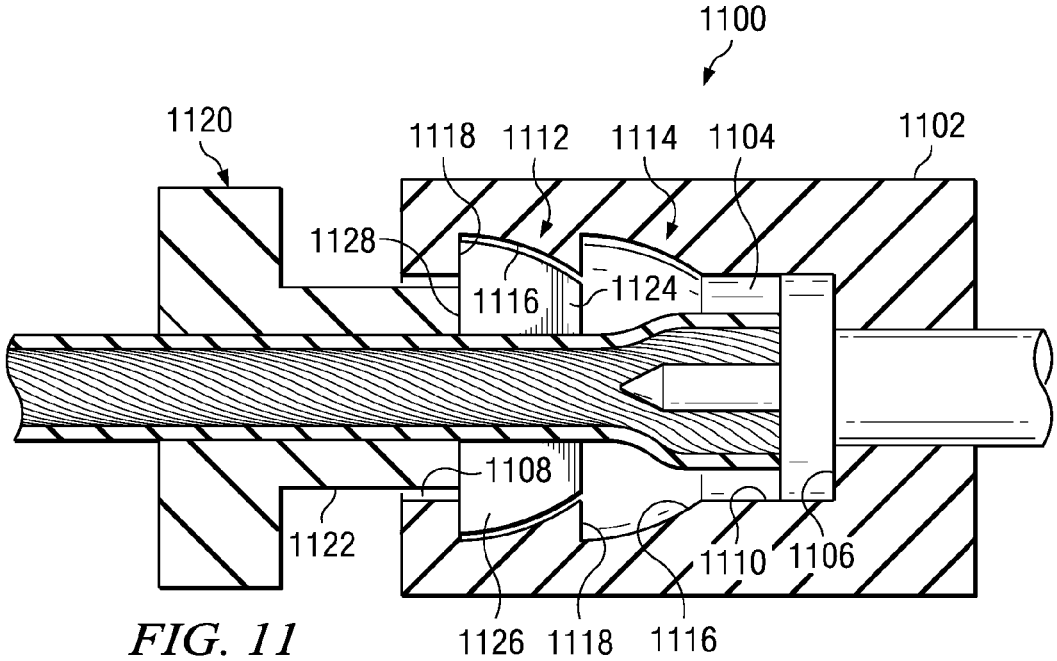
FIG. 11 is an axial sectional view of a connector body and cap according to a ninth embodiment of the invention with curved beveled surfaces, showing a first stage of assembly.

FIG. 11 shows a connector 1100 according to an embodiment of the invention in which the surfaces of the cap ridge and cavity grooves are other than straight in axial profile or section. A connector body 1102 has a bore or cavity 1104 with a bottom 1106 and an opening 1108. The cavity 1104 has a generally cylindrical sidewall 1110 (which in other embodiments can have an axial cross section that is other than circular, such as oval or polygonal) with a first groove 1112 proximate the cavity opening 1108 and a second groove 1114 displaced axially inwardly from the first groove 1112. Each of the grooves 1112, 1114 is made up of a first, axially inward surface 1116 and a second, axially outward surface 1118 which joins to the first surface 1116. The area of the axially inward surface 1116 substantially exceeds that of the axially outward surface 1118. It is preferred but not absolutely required that points on any axial section of the surfaces 1116, 1118 vary monotonically with respect to their radius from the connector axis. Many surfaces satisfy this general criterion; in the illustrated embodiment, the first beveled surface 1116 is concavely curved when taken in axial section (as shown), while the second surface 1118 is straight in axial section and is formed to conform to a plane which is orthogonal to the connector axis.

A cap 1120 has a shaft 1122 with a diameter which is slightly smaller than the diameter of the cavity 1104, and which is similar in cross-sectional shape to the general cross-section of cavity 1104. A ridge 1124 is formed to extend radially outwardly from the general exterior surface of shaft 1122. Here, ridge 1124 is disposed on the front end of cap shaft 1122 and has a leading surface 1126 and a trailing surface 1128. As for each of grooves 1112 and 1114, a surface area of the leading surface 1126 should be much larger than a surface area of the trailing surface 1128. The illustrated surface 1126 is a beveled surface which is convexly curved, while surface 1128 is formed to be planar and substantially orthogonal to the connector axis. Because the surface areas of surfaces 1116, 1126 greatly exceed the areas of respective adjoining surfaces 1118 and 1128, more force will be required to pull the cap 1120 out of the connector body 1102 than it will take to push the cap into either groove 1112 or groove 1114. This result will be obtained through a wide range of different shapes which surfaces 1116, 1118, 1126 and 1128 can take. One will obtain this result if the beveled surfaces 1116, 1126 are straight in cross section, as their analogs are in FIGS. 1-10B and 16A-24B, or take another shape as is shown here and in certain embodiments described below.

Figure 12:
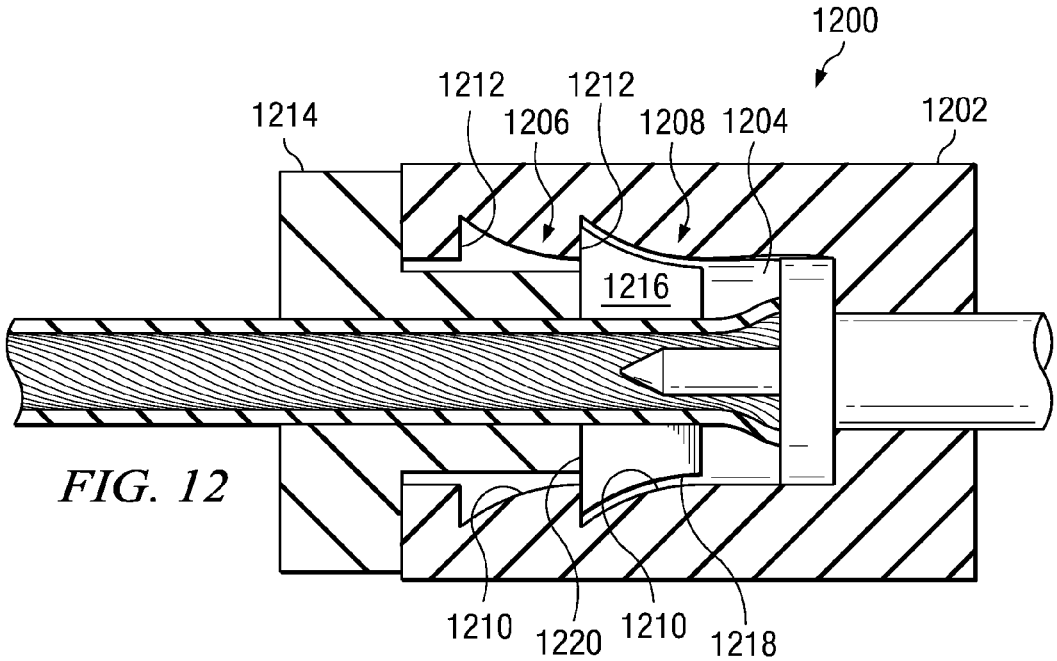
FIG. 12 is an axial sectional view of a connector body and cap according to a tenth embodiment of the invention with curved beveled surfaces, showing a second stage of assembly.

FIG. 12 illustrates an embodiment 1200 which in general is similar to connector 1100 shown in FIG. 11, but with a reversal in certain curved shapes. A connector body 1202 has a bore or cavity 1204 which has formed therein a first groove 1206. The first groove 1206 is disposed axially outwardly from a second groove 1208. Each groove 1206, 1208 is formed by two adjoining surfaces: an axially inward first surface 1210 which is convex in axial section, and a second, axially outward surface 1212 which extends radially inwardly from an end of surface 1210, which is straight in axial section, and which substantially conforms to a plane which is orthogonal to the connector axis. The surface pairs 1210, 1212 respectively making up grooves 1206, 1208 do not have to be identical and in one embodiment the areas of surfaces 1210, 1212 forming groove 1206 can be intentionally larger than those of respective surfaces 1210, 1212 forming groove 1208. Groove 1208 can be intentionally chosen to be tighter than groove 1206 to have a radially inwardly camming effect on a connector cap 1214. The cap 1214 has a ridge 1216 which is formed by two surfaces which at least roughly mirror cavity surfaces 1210, 1212: a leading surface 1218 which is concavely curved in axial section or profile, and a trailing surface 1220 which extends from an end of the leading surface, which is straight in axial section or profile, and which substantially conforms to a plane which is substantially orthogonal to an axis of the connector 1200. As in the other embodiments shown herein, the surface area of the axially inward surfaces 1210, 1218 substantially exceeds those of the axially outward surfaces 1212, 1220, and this in turn means that it will be harder to pull cap 1214 out of either groove 1206, 1208 than it will to push cap 1214 into groove 1206, 1208.

Figure 13A:
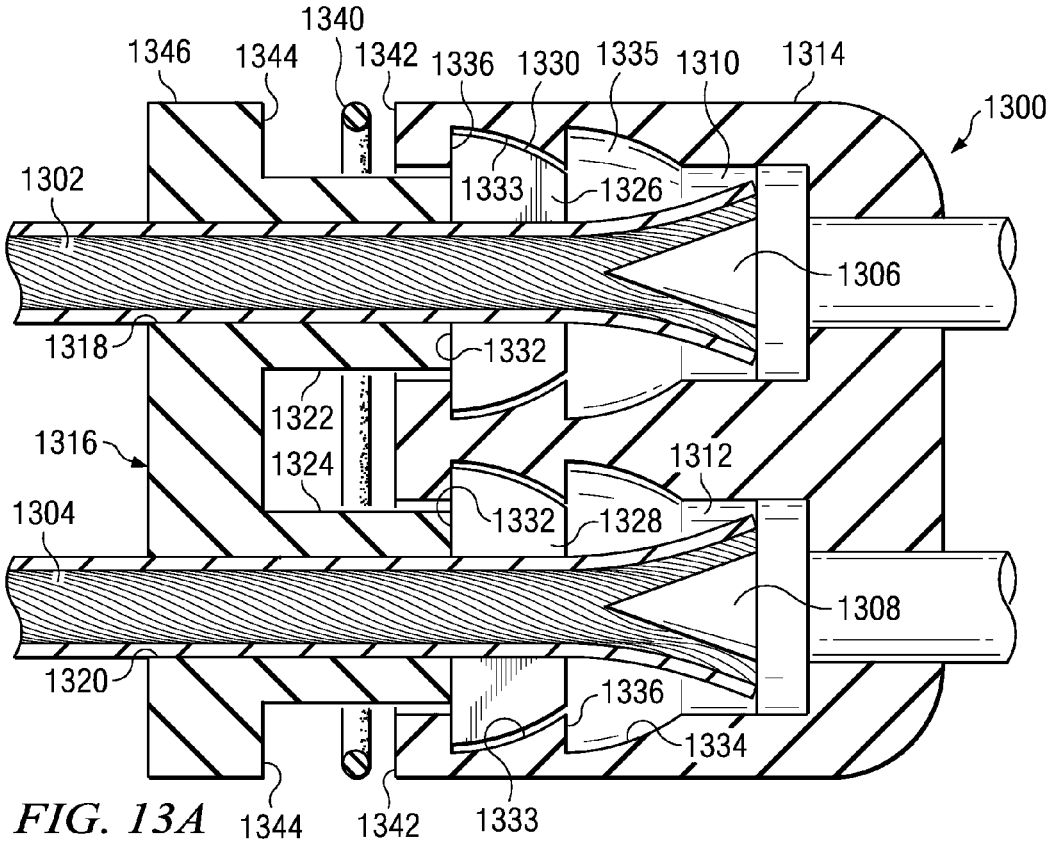
FIGS. 13A and 13B are sectional views of a parallel connector and cap according to an eleventh embodiment of the invention, showing first and second stages of assembly.
Figure 13B:
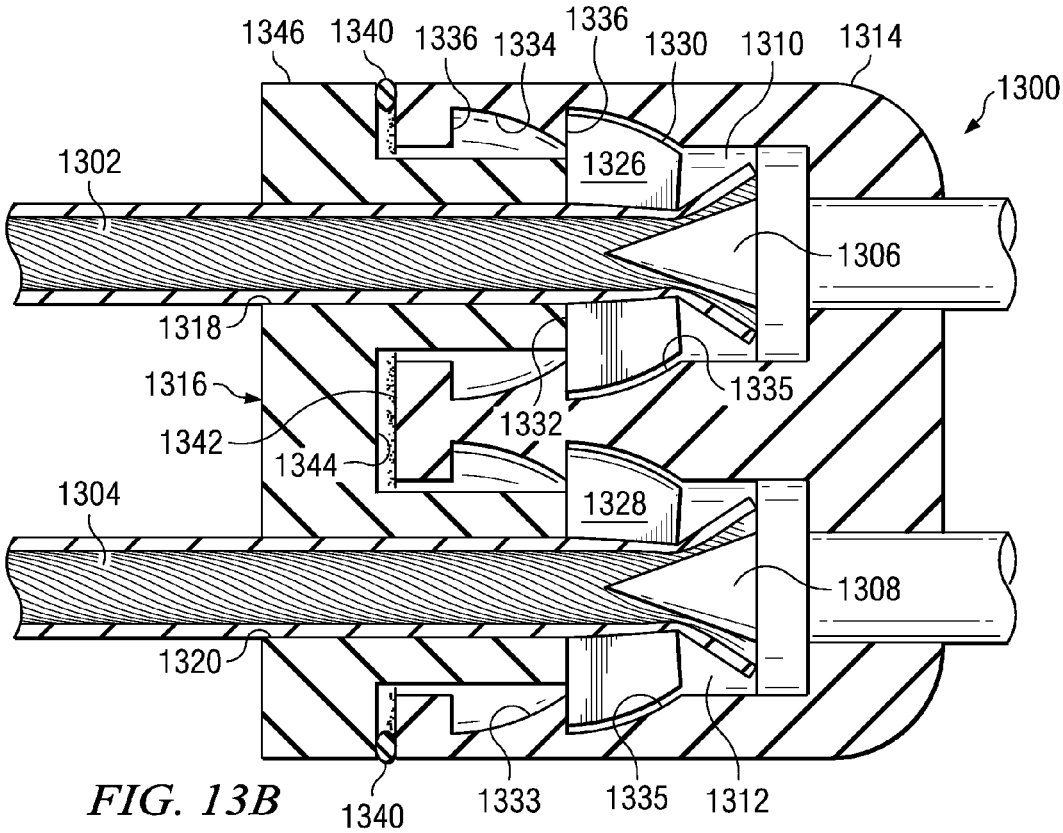

As previously mentioned, the present invention may be used to connect to more than one conductor. FIGS. 13A and 13B show a connector 1300 which connects two insulated conductors 1302, 1304 to respective connective elements 1306, 1308 in the respective bottoms of cavities 1310, 1312 of a single connector body 1314. In this embodiment, a unitary cap 1316 has a first bore or cavity 1318 through which conductor 1302 is inserted, and a second bore or cavity 1320 through which conductor 1304 is inserted. Plural and parallel cap shafts 1322, 1324 respectively house the bores 1318, 1320 and, in this embodiment, are terminated at their inner axial ends by ridges 1326, 1328. In other embodiments ridges 1326, 1328 can be disposed elsewhere on the shafts 1322, 1324 as is convenient. Ridge 1326 has, in this illustrated embodiment, a convex leading beveled surface 1330 and a planar and axially orthogonal trailing surface 1332. Ridge 1328 is similar. Bore or cavity 1310 has two grooves 1333, 1335 formed in it, each by a first, axially inward beveled surface 1334 and a second, axially outward surface 1336 whose surface area is substantially less than that of first surface 1334. In the illustrated embodiment, beveled surface 1334 is chosen to be concavely curved and surface 1336 is chosen to be planar and orthogonal to the connector bore axis. The surfaces of the grooves in cavity 1312 are similarly constructed.

FIG. 13A shows this multiple connector/cap embodiment in a first position, in which the conductors have been inserted through the cap bores 1318, 1320 and into the connector cavities 1310, 1312 to be impaled on conductive elements 1306, 1308. The cap ridges 1326, 1328 are respectively registered in the first, axially outward set of grooves 1333. In FIG. 13B, the multiple-conductor cap 1316 has been compressed axially inwardly (either manually or with means such as a plier) until the cap ridges 1326, 1328 register with second, axially inward grooves 1335. As this happens, an elastomeric o-ring 1340, which extends around all cap shafts 1322, 1324, is compressed between an axially outward face 1342 of the connector body 1314 and an axially inner face 1344 of an enlargement 1346 of the common cap body 1316, sealing all bores 1310, 1312.

Figure 14:
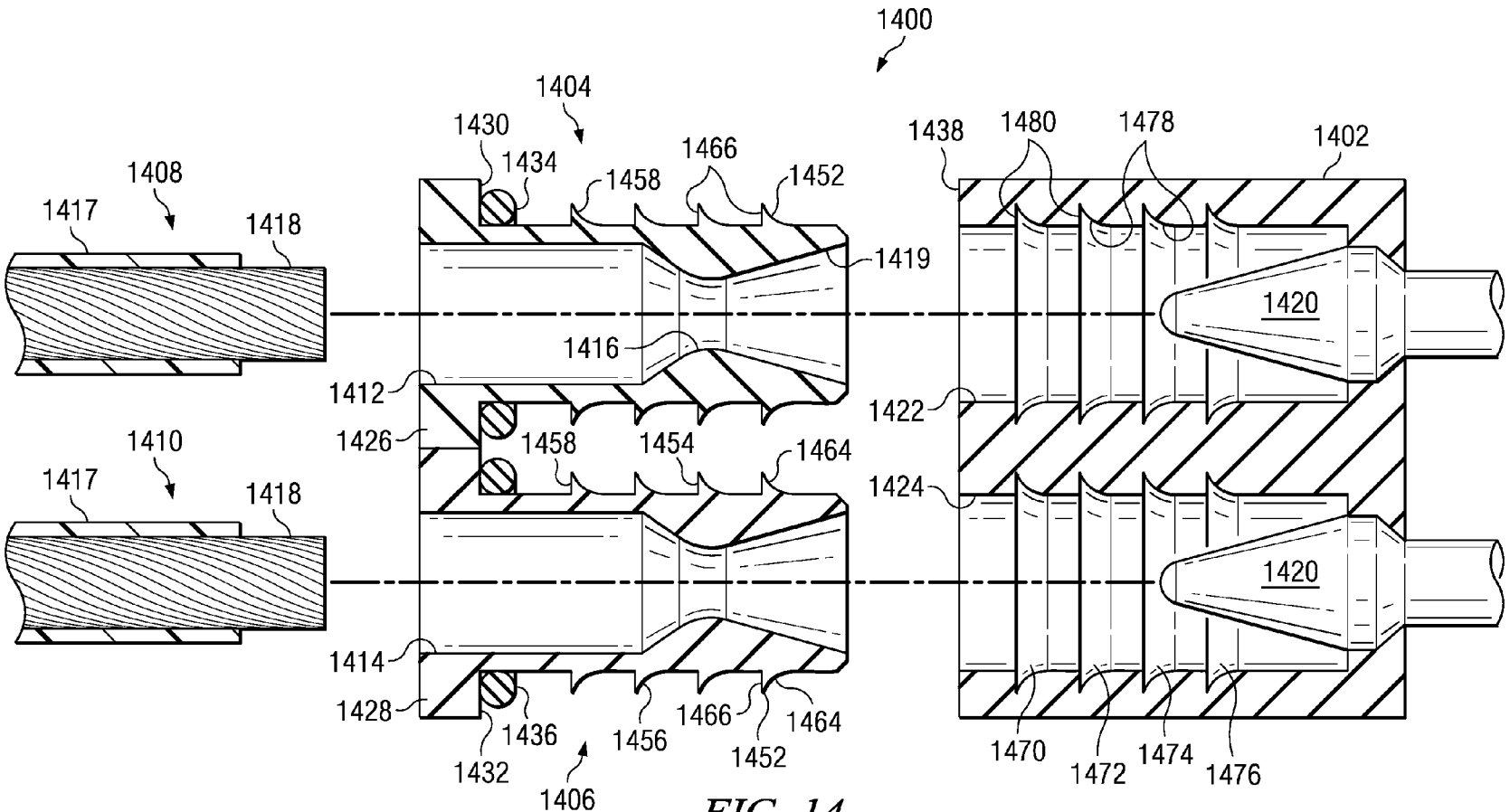
FIG. 14 is an exploded sectional view of a parallel connector body and multiple caps according to a twelfth embodiment of the invention.

FIG. 14 illustrates another multiple-conductor connector 1400 having a multiple-bore body 1402 and plural caps 1404, 1406. Each cap 1404, 1406 receives a respective insulated conductor 1408, 1410 through a respective cap bore 1412, 1414. In cap bore or cavity 1412 (cap bore 1414 being similar), there is a constriction 1416 creating a stop against which the insulation 1417 of conductor 1408 abuts, and beyond which only the stripped conductive core 1418 continues. The inner axial end of the cap bore 1412 flares out into a frusto-conical shape 1419 which is complementary to a substantially conical conductive element 1420 located in a respective one of the bores 1422, 1424 of the connector body 1402. Each cap has, on its outer axial end, an enlargement 1426, 1428 with a respective axially inward face 1430, 1432 against which a respective o-ring 1434, 1436 is seated. When caps 1404, 1406 are fully inserted into their respective connector body cavities 1422, 1424, the o-rings 1434, 1436 will be compressed between inner faces 1430, 1432 of the caps 1404, 1406 and an axially outward face 1438 of the connector body 1402.

Each of the caps 1404, 1406 has a series of axially circumferential ridges 1452-1458 arranged along their generally cylindrical exterior shaft surfaces 1460, 1462. As in other embodiments disclosed herein, each of the ridges 1452-1458 is formed of two surfaces: a leading surface 1464 and a trailing surface 1466, where the surface area of the leading surface 1464 is substantially greater than the area of the trailing surface 1466. Here, the leading surfaces 1464 are chosen to be concavely curved in axial section, while the trailing surfaces 1466 are chosen to be planar and orthogonal to the cap/connector body bore axis. Surface pairs 1464, 1466 can be chosen to have other axial profiles than the one shown, such as ones which are straight or convexly curved.

The bores 1422 and 1424 have an interior sidewall which is generally cylindrical (where "cylindrical" takes its broad mathematical definition of a three-dimensional shape having a uniform cross-section along its axis; the axial section thereof need not be circular). But the bores 1422 and 1424 each have a plurality of grooves 1470-1476 in them that are spaced apart from each other with the same interval as the spacing apart of the plural cap ridges 1452-1458. Each groove 1470-1476 is made up by two surfaces: a first surface 1478 which is axially inward, and a second surface 1480 which is axially outward and which extends from an end of a surface 1478. The first surface 1478 has a much larger area than the adjoining surface 1480. Here, the first surfaces 1478 are chosen to be convexly arcuate in axial section, while the second surfaces 1480 are planar and are substantially orthogonal to the bore axis.

In this embodiment, each cap 1404, 1406 may be individually advanced down a respective bore 1422, 1424 until the cap "snaps" to one of four positions, respectively defined by grooves 1470-1476. This permits various degrees of the compression of the conductive core 1418 between surface 1419 and cone 1420, which in turn permits of some variation in wire or conductor size. In an alternative embodiment, the greatest diameter of ridges 1452-1458, and the greatest diameters of grooves 1470, 1476, may decrease as one proceeds axially inward, yielding a progressively tighter fit as the cap is compressed from one detented position to the next.

Figure 15:
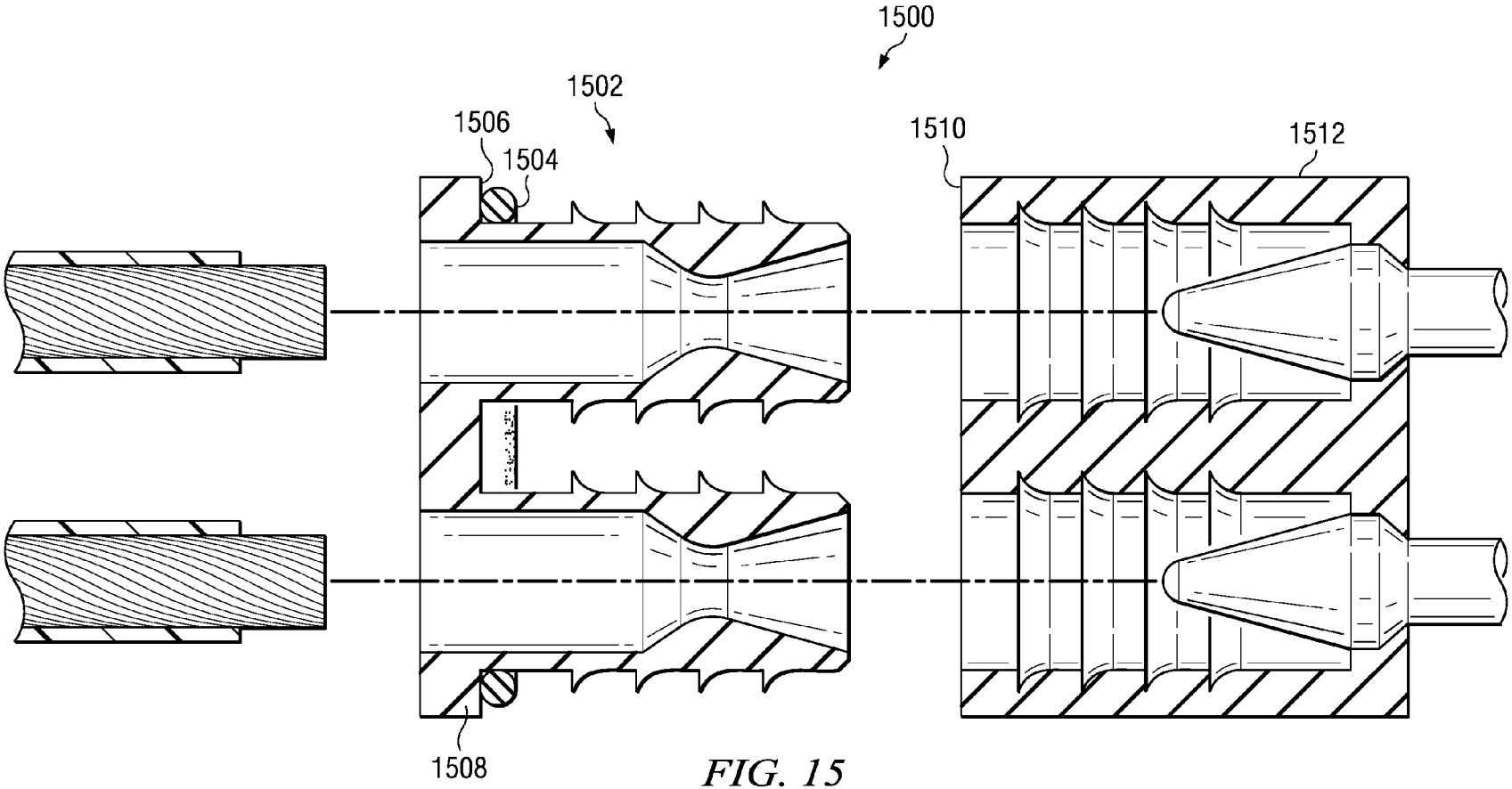
FIG. 15 is an exploded sectional view of a parallel connector body and parallel cap according to a thirteenth embodiment of the invention.

The connector 1500 shown in FIG. 15 is in general similar to connector 1400 (FIG. 14), but in substitution for caps 1404, 1406 there is provided a single multiconductor cap 1502. A single o-ring 1504 is compressible between an inner face 1506 of an axially outward cap enlargement 1508 and an axially outward face 1510 of a connector body 1512.

Figure 16A:
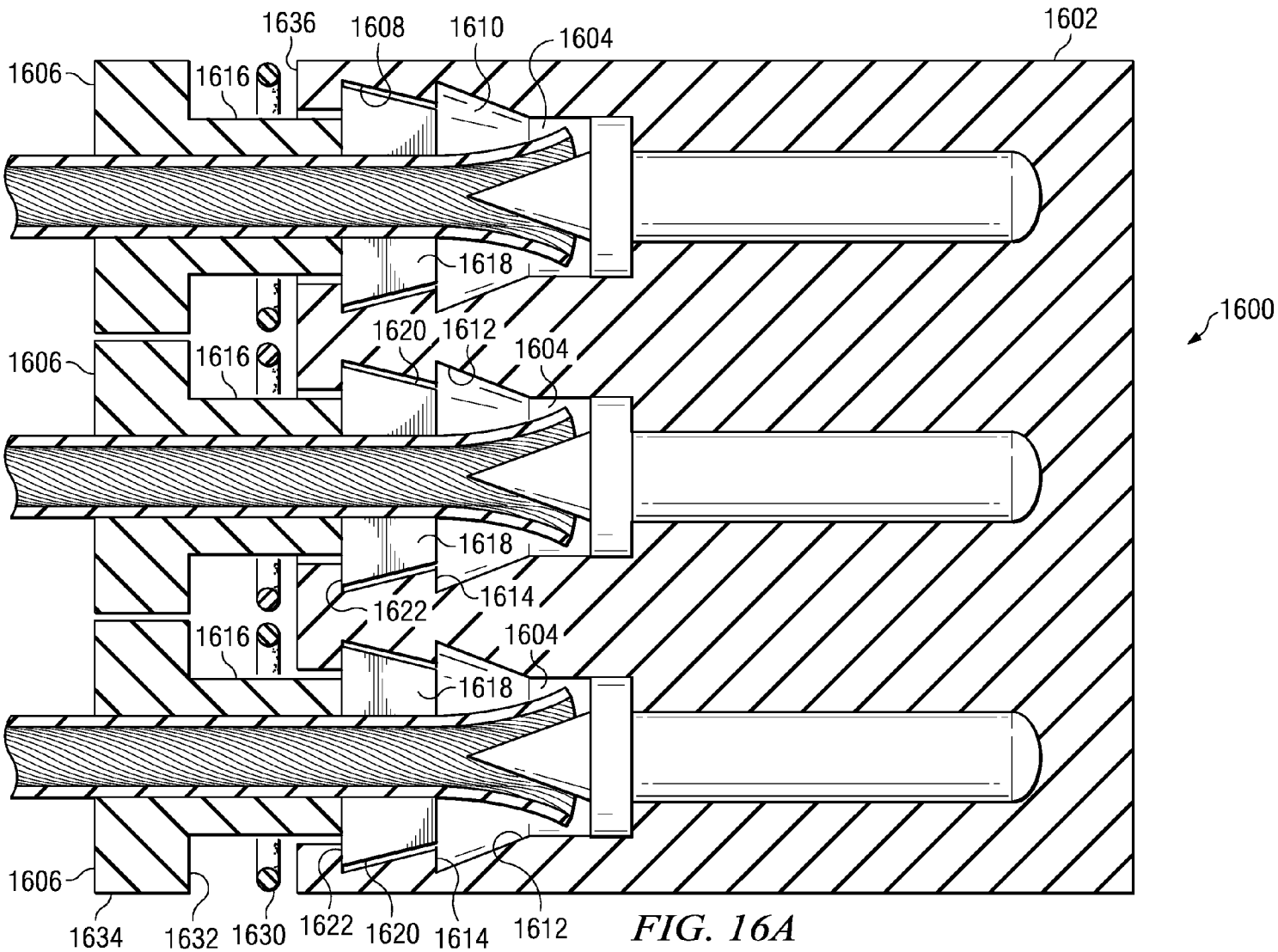
FIGS. 16A and 16B are sectional views of a parallel connector body and multiple caps according to a fourteenth embodiment of the invention, showing first and second stages of assembly.
Figure 16B:
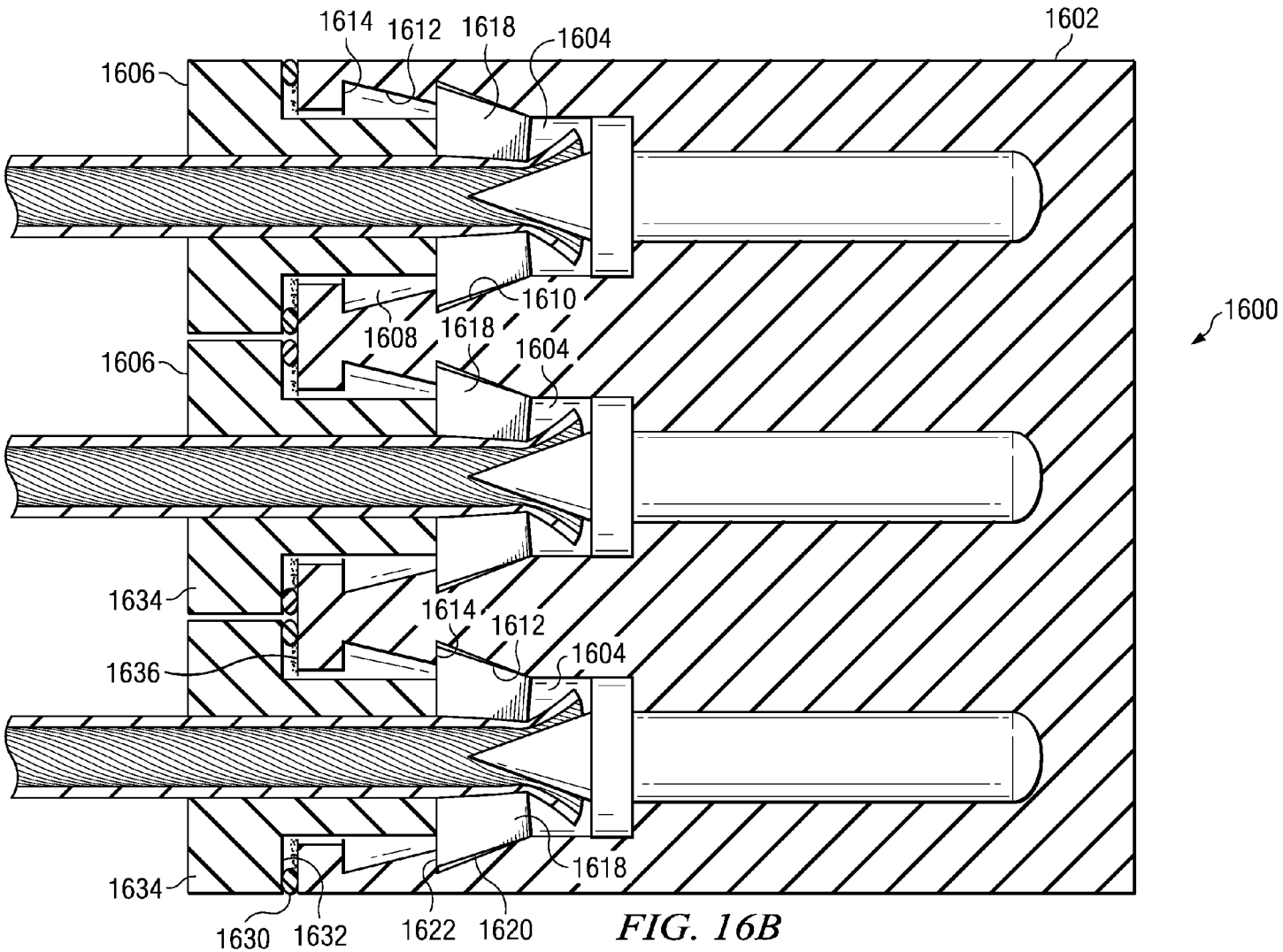

FIGS. 16A-16B show a connector 1600 with a body 1602 having parallel, multiple bores or cavities 1604 and separate caps 1606 adaptable to be received into them. Each bore has a first groove 1608 and a second groove 1610 spaced axially inwardly from the first groove 1608. Each groove is composed of a first, axially inward surface 1612 which is joined at its end to a second, axially outward surface 1614, with the area of surface 1612 being chosen to be substantially greater than the area of surface 1614. Here, the first beveled surfaces 1612 are chosen to be frustoconical and the second surfaces 1614 are chosen to be planar and substantially orthogonal to the bore axis. As mentioned for other embodiments herein, the axial profiles of surfaces 1612, 1614 can be chosen to be other than straight, such as any of various curves. Each cap 1606 has a shaft 1616 which terminates in an axially inward direction with a ridge 1618, composed of leading and trailing surfaces 1620, 1622 which at least somewhat mirror surfaces 1612, 1614 of grooves 1608, 1610. The area of leading surface 1620 is substantially greater than the area of trailing surface 1622, and in the illustrated embodiment leading surface 1620 is frustoconical while trailing surface 1622 forms an annulus which is planar and orthogonal to the bore axis. An o-ring 1630 is provided for each separate cap shaft 1616 so that an axially inward face 1632 of a cap enlargement 1634 may be individually sealed against an axially outward face 1636 of the connector body 1602.

Figure 17A:
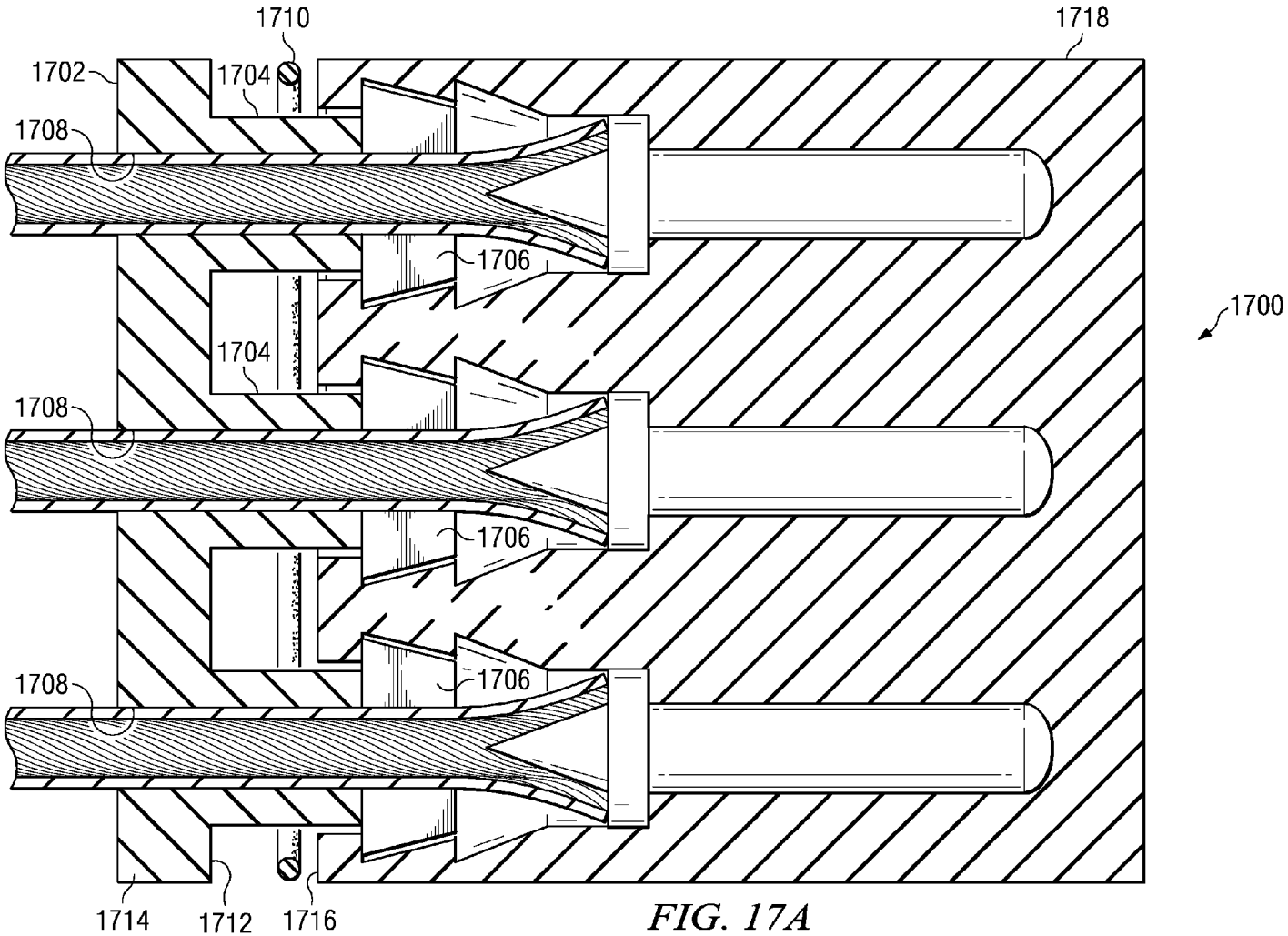
FIGS. 17A and 17B are sectional views of a parallel connector body and parallel cap according to a fifteenth embodiment of the invention, showing first and second stages of assembly.
Figure 17B:
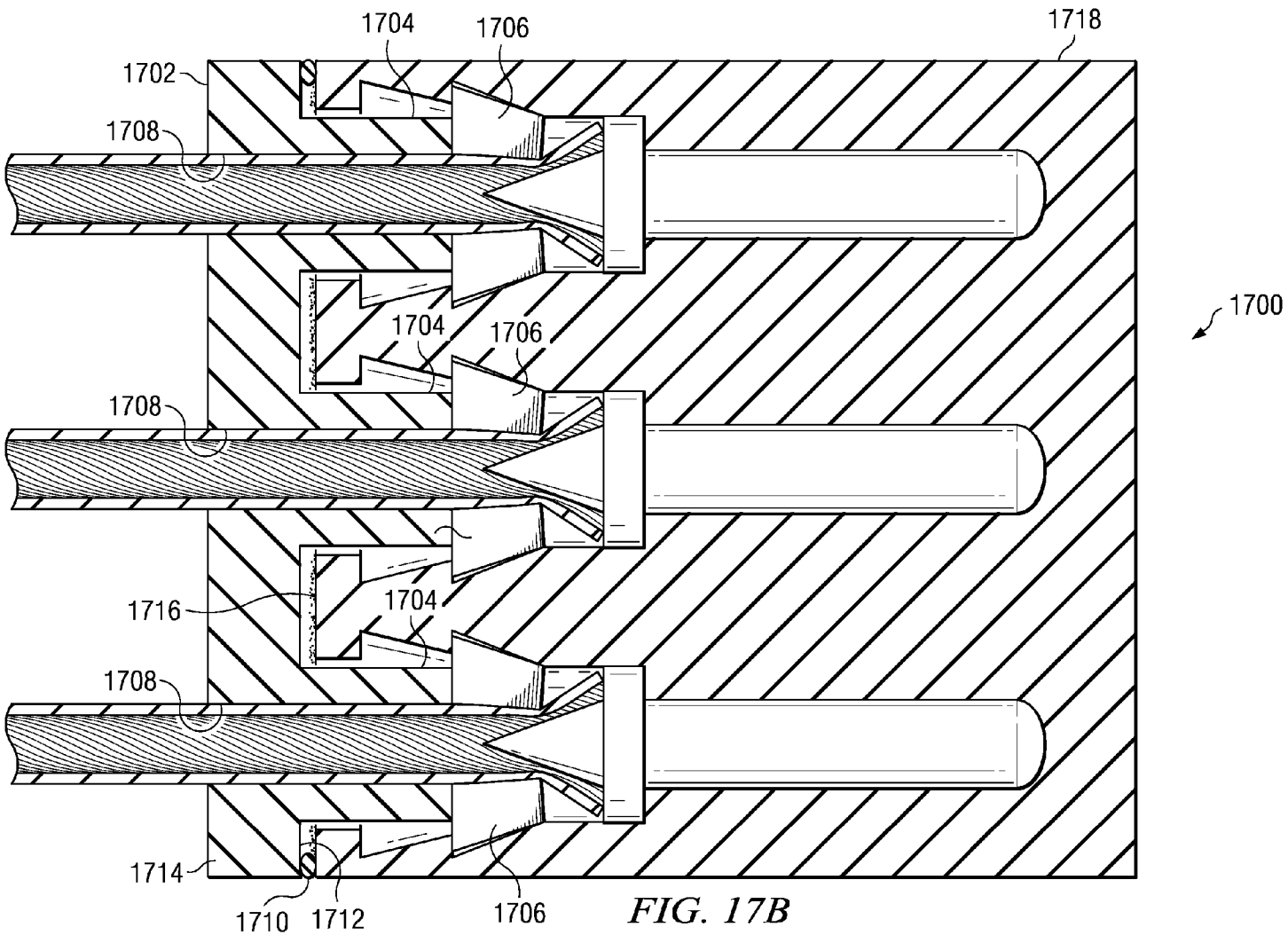

The connector 1700 shown in FIGS. 17A-17B is in general similar to the connector 1600 shown in FIGS. 16A-16B, but instead of individual caps 1606 there is provided a unitary, multiple-conductor cap 1702 with multiple shafts 1704, cap-terminating ridges 1706 and conductor-receiving cavities or bores 1708. A common o-ring 1710 is disposed between an axially inward surface 1712 of an axially outward cap enlargement 1714 and an axially outward face 1716 of the connector body 1718.

Figure 18:
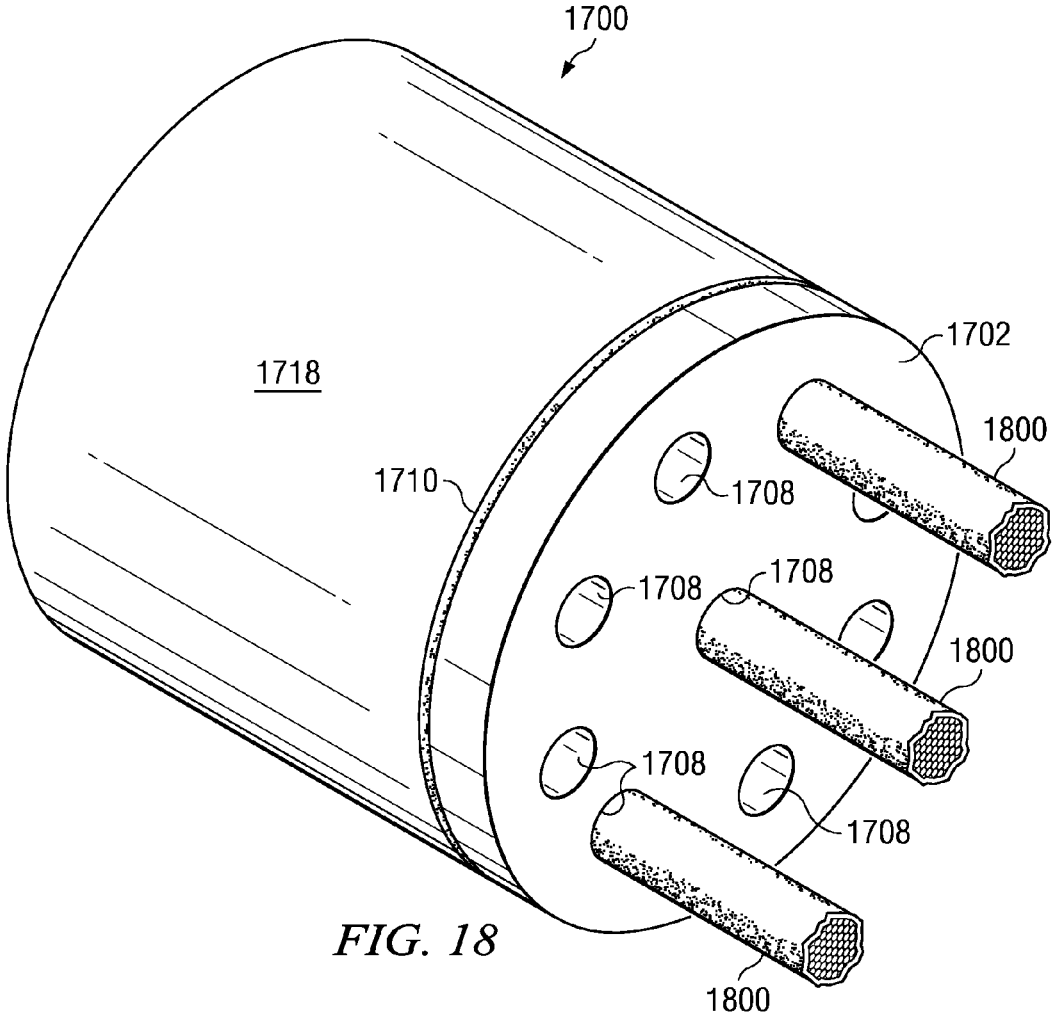
FIG. 18 is an isometric view of the connector shown in FIG. 17B.

FIG. 18 is an isometric view of the connector 1700 and shows how the body 1718 can have multiple parallel bores into each of which are received respective ones of the shafts 1704 (FIGS. 17A-17B). These bores can be in other than a planar array, as is demonstrated by the three-dimensional distribution of cap cavities or bores 1708. The user may decide to use only some of the bores 1708 for the connection of respective insulated conductors 1800.

Figure 19A:
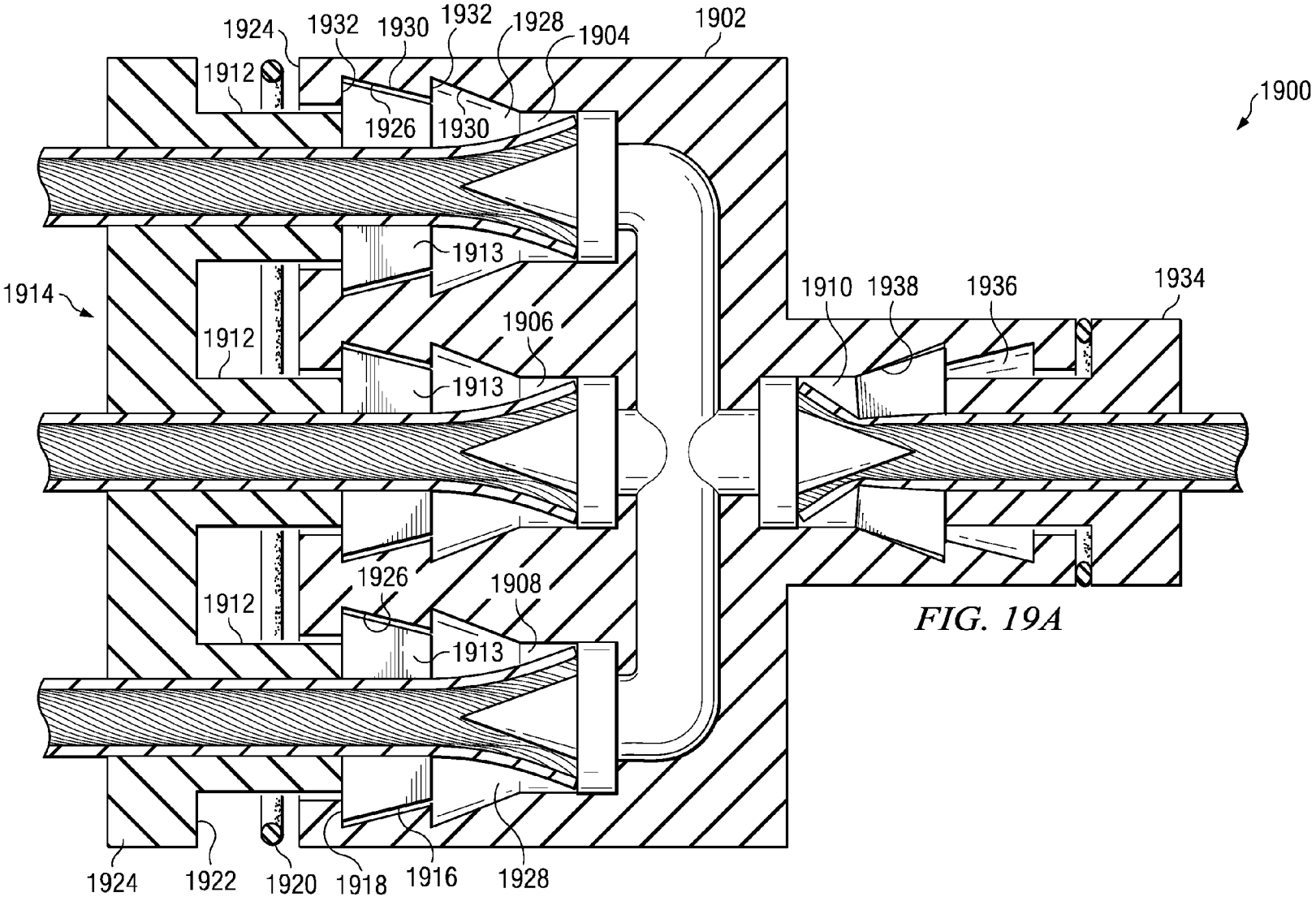
FIGS. 19A and 19B are sectional views of a multiple-to-one connector body receiving a multiple-conductor cap on one side and a single cap on a second side, according to a seventeenth embodiment of the invention and respectively showing first and second stages of assembly.
Figure 19B:
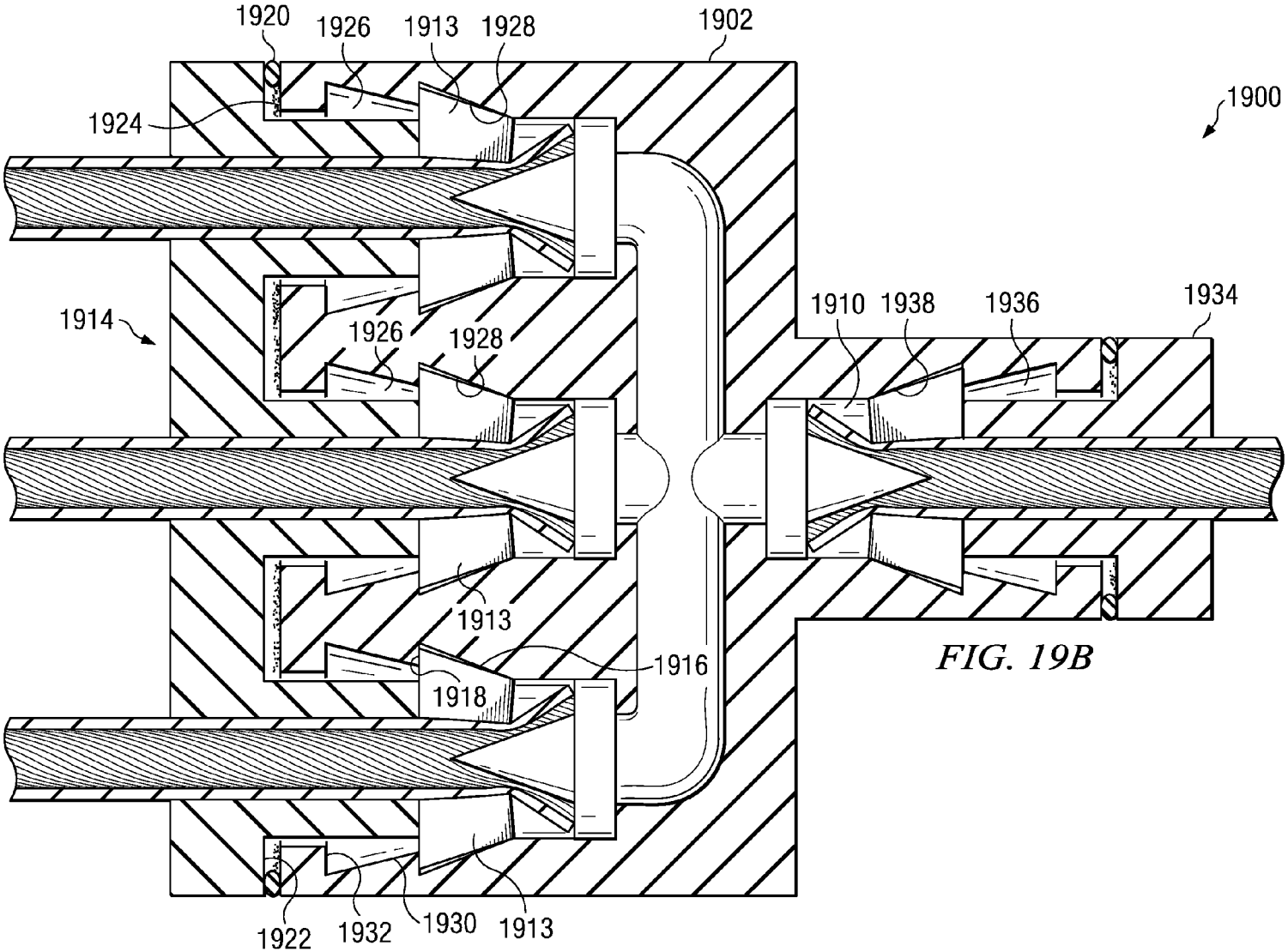

The connector 1900 shown in FIGS. 19A and 19B has a connector body 1902 with a first side having multiple parallel bores or cavities 1904-1908 and a second side having a single bore or cavity 1910. The bores 1904-1908 receive respective parallel shafts 1912 of a unitary, multiple-conductor cap 1914. Each shaft 1912 terminates in a ridge which (as in other embodiments herein) is made up of a frustoconical leading surface 1916 and an annular and axially orthogonal trailing surface 1918. As in other embodiments discussed herein, the axial profiles of the surfaces 1916, 1918 can be chosen to be other than straight, such as any of various curves, so long as leading surface 1916 has an area which is substantially larger than the area of trailing surface 1918. A single o-ring 1920 seals between an inner face 1922 of an enlargement 1924 of the cap 1914 and a face 1924 of the connector body 1902. Each bore 1904-1908 is generally cylindrical so as to admit the shafts 1912 but has first and second grooves 1926, 1928, each of which is composed of a first, inward, frustoconical surface 1930 and a second, outward axially orthogonal and annular surface 1932. Surfaces 1930 and 1932 can be chosen to be other than straight in axial profile, so long as the area of surface 1930 substantially exceeds the area of surface 1932.

The bore 1910 on the single-conductor side receives a single-conductor cap 1934 which is similar in construction to cap 100 (FIG. 1), 400 (FIG. 4) or 1606 (FIGS. 16A-B). The bore 1910 has at least two grooves 1936, 1938 which in the illustrated embodiment are similar to grooves 1926, 1928 on the multiple-conductor side.

Figure 20A:
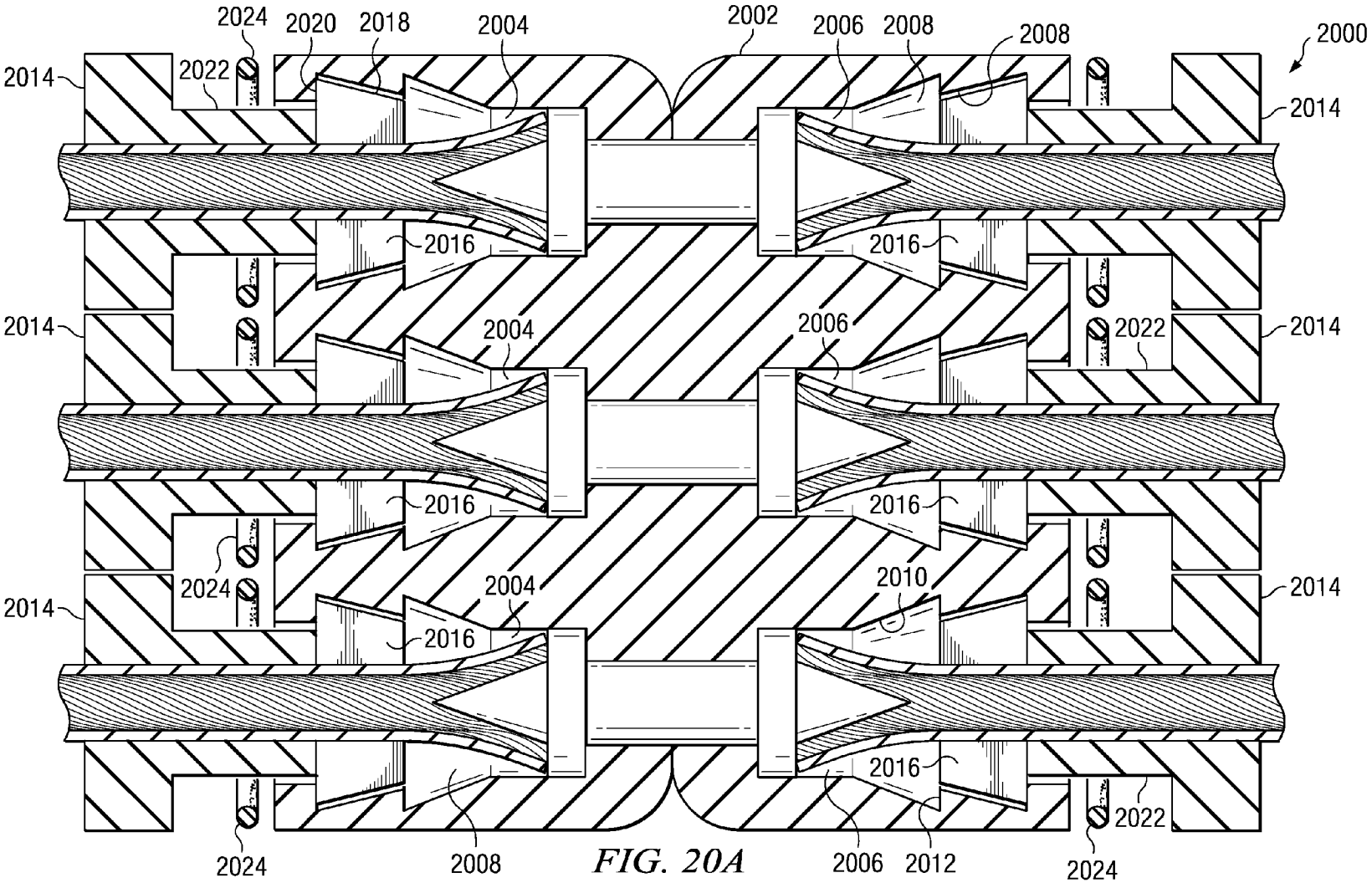
FIGS. 20A and 20B are sectional views of a connector body receiving multiple conductor caps on opposite sides thereof, according to an eighteenth embodiment of the invention and respectively showing first and second stages of assembly.
Figure 20B:
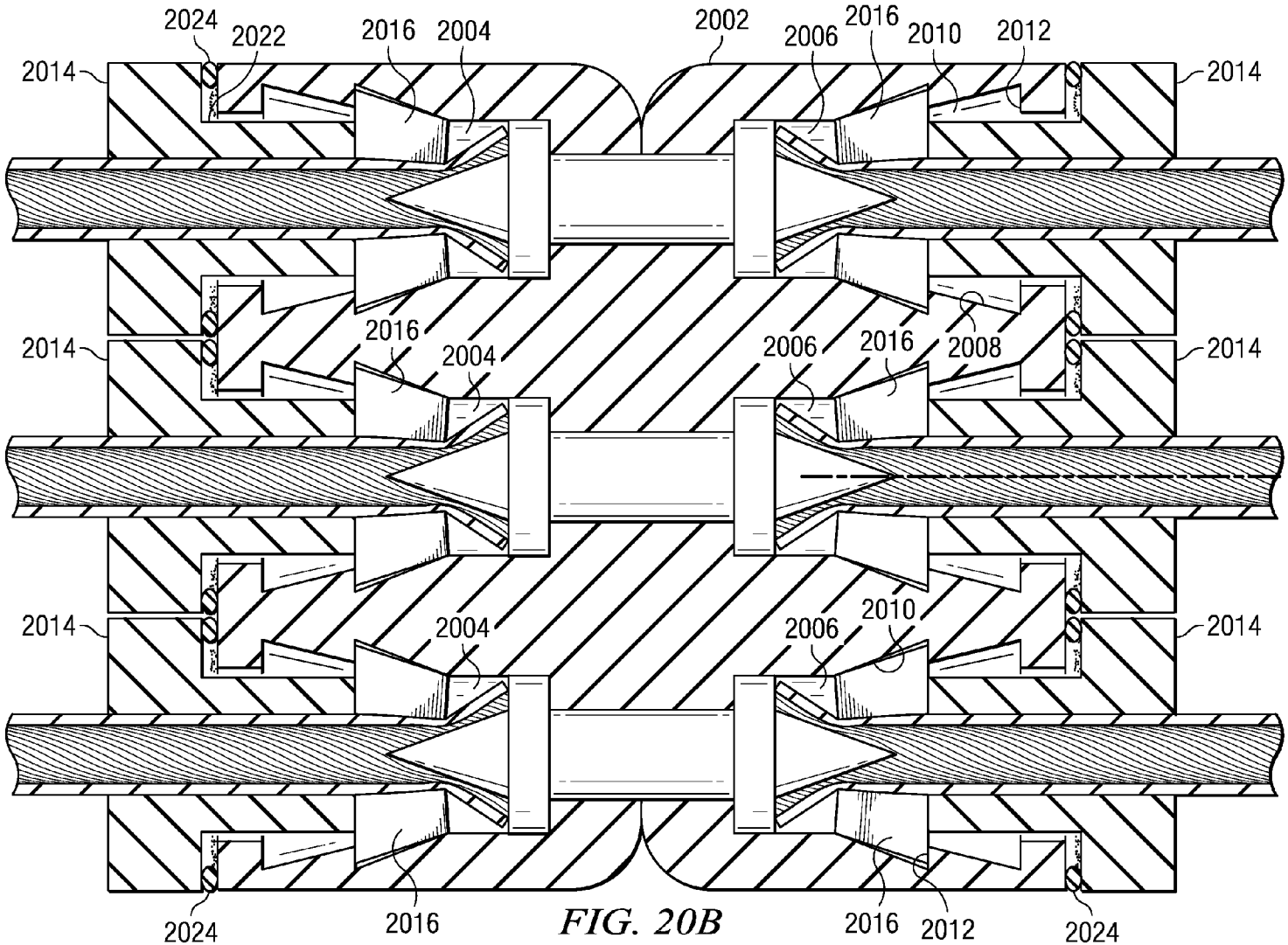

The many-to-many connector 2000 shown in FIGS. 20A and 20B has a body 2002 which has formed therein a parallel plurality of bores or cavities 2004 on a first side thereof and a parallel plurality of bores or cavities 2006 on a second, opposed side thereof. The bores 2004, 2006 all have at least two grooves 2008 axially displaced from each other and formed by first, frustoconical surfaces 2010 and second, orthogonally annular surfaces 2012. Surfaces 2010, 2012 can alternatively be specified as having other than straight axial profiles, as long as beveled surfaces 2010 have areas which are substantially greater and the areas of surfaces 2012. Each bore 2004, 2006 receives a respective single-conductor cap 2014 with a ridge 2016 formed of a leading frustoconical surface 2018 and a trailing, orthogonally annular surface 2020. As can be done for surfaces 2010, 2012, surfaces 2018, 2020 can be alternatively chosen to have other than a straight axial profile, so long as surface 2018 has an area which is substantially greater than surface 2020, and so long as surfaces 2018, 2020 at least roughly mirror groove surfaces 2010, 2012. Shafts 2022 of the caps 2014 are provided with individual o-rings 2024.

Figure 21A:
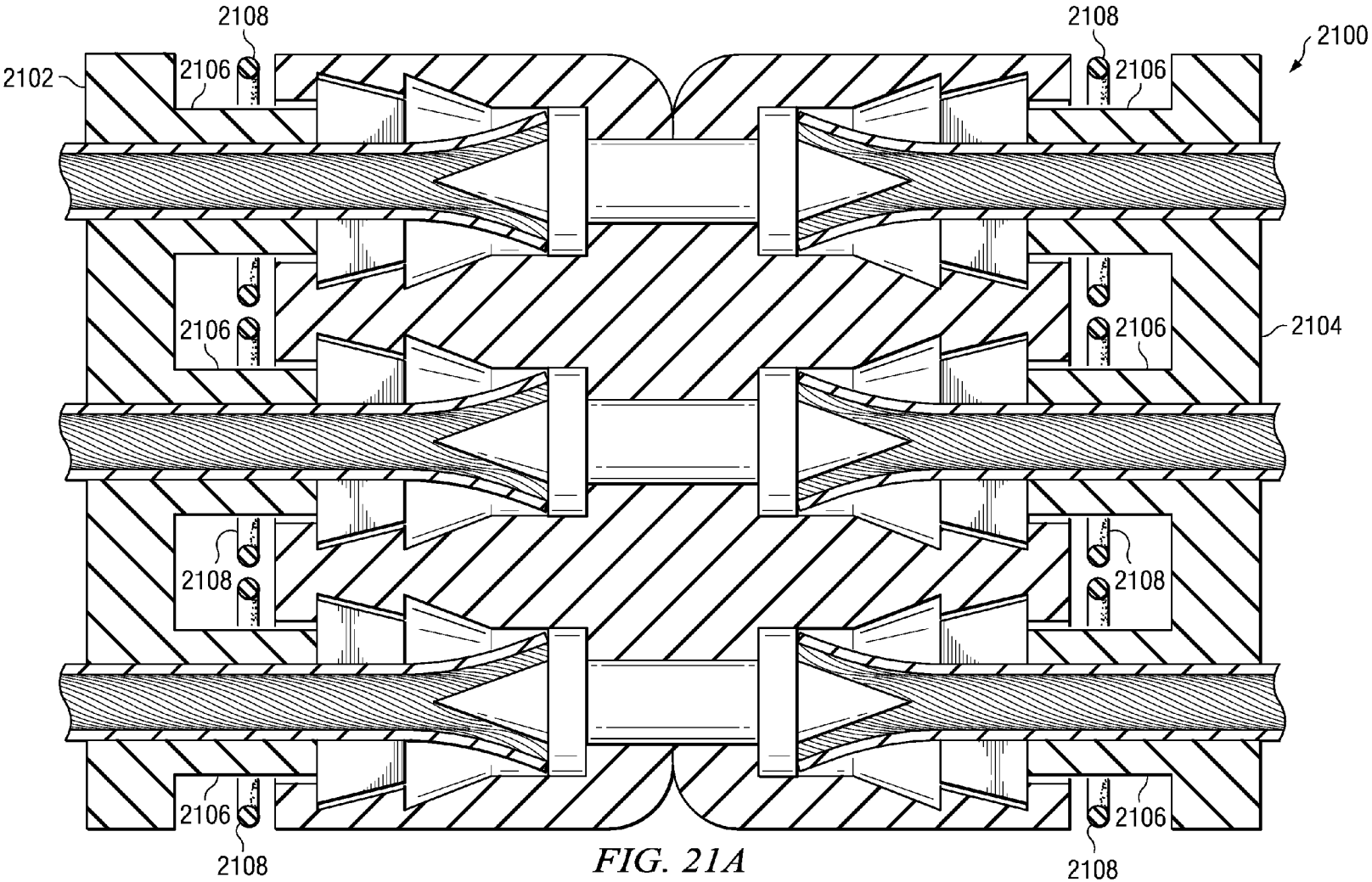
FIGS. 21A and 21B are sectional views of a connector body receiving multiple conductor caps on opposite sides thereof, according to a nineteenth embodiment of the invention and respectively showing first and second stages of assembly.
Figure 21B:
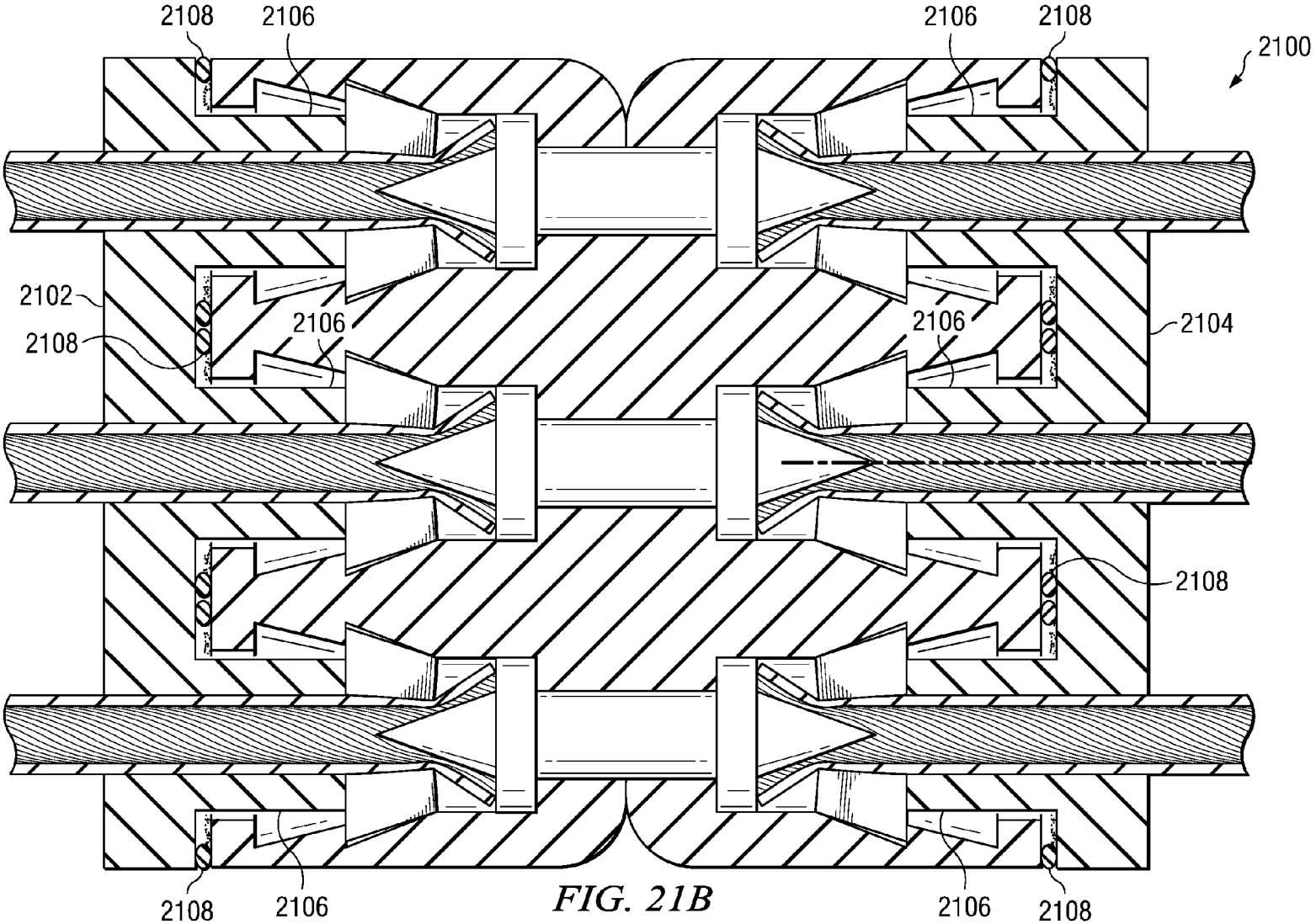

Yet a further embodiment of a many-to-many connector 2100 is shown in FIGS. 21A-21B. Connector 2100 is similar to connector 2000 as shown in FIGS. 20A-20B, except that multiple-conductor caps 2102, 2104 have been substituted for individual-conductor caps 2014. In this embodiment, the caps 2102, 2104 each have multiple shafts 2106, and each cap shaft is provided with its own o-ring 2108. The structure of the multiple-conductor caps 2102, 2104 is similar to cap 1702 (FIGS. 17A-B) or cap 1914 (FIGS. 19A-B).

Figure 22A:
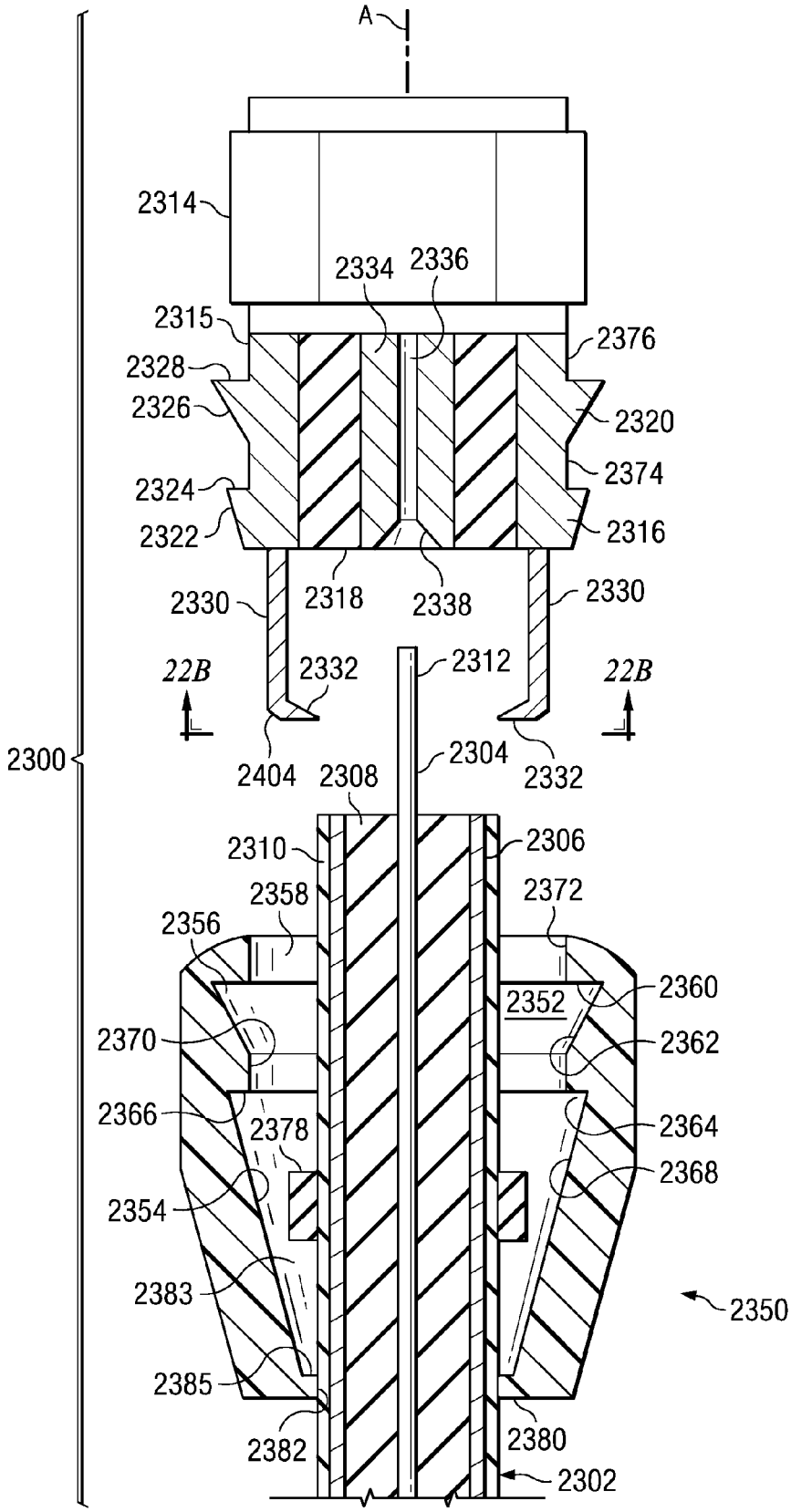
FIG. 22A is an exploded axial sectional view of a connector body and cap according to a twentieth embodiment of the invention adapted to terminate a stripped coaxial cable.

FIG. 22A is an exploded view of a connector 2300 suitable for terminating a coaxial cable 2302. The coaxial cable 2302 has a solid center conductor 2304 and a conductive sheath 2306, both of which require connection to further electronic components. Sheath 2306 and central conductor 2304 are separated by coaxial insulation 2308 and the entirety of cable 2302 is protected by a layer of external insulation 2310. This embodiment is provided for coaxial conductor ends from which insulation 2310, sheath 2306 and insulation 2308 have been stripped, leaving a bare length 2312 of the central conductor 2304.

A coaxial cable connector body 2314 has a generally cylindrical exterior surface 2315 (as "cylindrical" is understood in its broad mathematical definition, meaning having a substantially uniform cross section throughout its axial length; e.g. body 2314 could be polygonal, oval or otherwise noncircular in axial cross-section) that is formed in whole or in part of a conductive material. In the illustrated embodiment, the body 2314 has a first ridge 2316 proximate a front face 2318 of the body. The ridge 2316 is formed to be at an angle to the axis A and is preferably orthogonal thereto. Spaced from this first ridge 2316 to be more remote from the front face 2318 is a second ridge 2320. Second ridge 2320 is formed at an angle to the axis and preferably is orthogonal thereto. Both the first and second ridges are preferred to be circumferential relative to the axis A of the connector 2300, but they could be discontinuous. A radius of ridge 2316 at its largest point is greater than a radius of the generally cylindrical surface 2315 of the body 2314. Preferably the greatest radius of ridge 2320 is greater than the greatest radius of ridge 2316.

The ridge 2316 is formed by a leading surface 2322 which extends axially rearwardly and radially outwardly from the general cylindrical surface 2315, and a trailing surface 2324 joined to an outer end of the leading surface 2322 and extending radially inwardly back to the general exterior surface 2315. The leading surface 2322 and the trailing surface can each take various shapes (e.g., they can be straight, convexly curved or concavely curved), but the leading surface 2322 should always have an area which is substantially greater than the area of trailing surface 2324. Surface pairs 2322, 2324 which satisfy this criterion will exhibit more resistance to cap/conductor pullout than they will to cap/conductor assembly to the body 2314. In the illustrated embodiment, surface 2322 begins at front connector body face 2318 and is frustoconical; in other embodiments surface pairs 2322, 2324 could be displaced rearwardly on the general exterior surface 2315. The trailing surface 2324 in the illustrated embodiment is annular and conforms to a plane which is orthogonal to axis A.

In the illustrated embodiment the second ridge 2320 is likewise formed by a leading surface 2326 and trailing surface 2328. The leading surface starts at the radius of the general exterior surface 2315 and proceeds radially outwardly and axially rearwardly until its junction with trailing surface 2328, at which point its radius from axis A is greater than the radius of the generally exterior surface 2315. Trailing surface 2328 extends radially inwardly until it meets the general outer surface 2315 of the connector body 2314. In the illustrated embodiment, surface 2326 is frustoconical and surface 2328 is annular and orthogonal to axis A, but they could be chosen to be otherwise. For example, surfaces 2326 and/or 2328 could be convexly or concavely curved. But the area of leading surface 2326 should always be greater than that of trailing surface 2328.

Figure 22B:
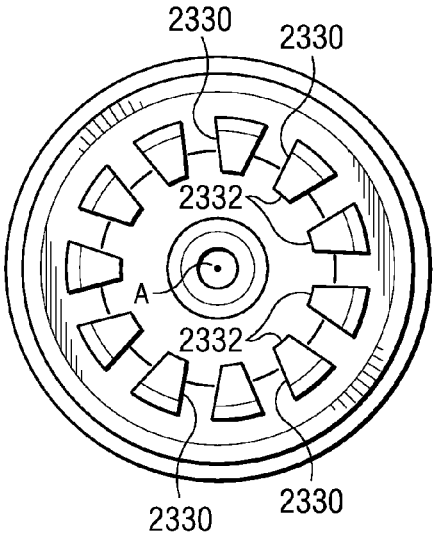
FIG. 22B is a detail of the piercing fingers of the connector seen in FIG. 22A and taken substantially along line 22B-22B of FIG. 22A.

Conductively connected to the connector body 2314 are a plurality of conductive piercing fingers 2330, two of which are shown in FIG. 22A. FIG. 22B is an end-on view of fingers 2330, illustrating their axially circumferential distribution. Each finger 2330 has a shoulder 2404 from which extends in a radially inward direction a point or edge 2332 that is long enough and sharp enough to pierce through the insulation 2310 and contact conductive sheath 2306. Points or edges 2332 should not be so long that they would penetrate to central conductor 2312. In an initial, uncompressed position, the fingers 2330 do not engage the external insulation 2310 of coaxial conductor 2302 but permit the insertion of coaxial conductor 2302 to the face 2318 of the body 2314.

In this embodiment, the body 2314 has a conductive central portion 2334 with a bore 2336. Bore 2336 may be beveled at its entrance 2338 so that stripped central conductor 2312 may be more easily inserted into bore 2336.

The other major component of coax connector 2300 is a cap 2350 having an axial cavity 2352 through which the coax conductor 2302 is threaded. The cap 2350 may be formed of either conductive or insulative material. An internal sidewall 2354 of the cap 2350 has a first groove 2356 formed to be near an axially inward opening 2358 of the cap 2350. The groove 2356 is formed at an angle to axis A (preferably at right angles to it) and has a radius at its deepest point from axis A which is greater than the radius of an adjacent portion of the inner cavity sidewall 2354. The first groove 2356 is made up of a first, leading surface 2360 and a second, trailing surface 2362. The area of leading surface 2360 should be chosen to be substantially less than that of the trailing surface 2362. In the illustrated embodiment, the leading surface 2360 is formed to be an annulus at right angles to axis A, and the trailing surface 2362 is formed to be frustoconical. Surfaces 2360, 2362 may be chosen to be straight in axial cross section or profile (as shown) or could be convexly or concavely curved, or take other shapes.

The internal sidewall 2354 has a further, second groove 2364 which is formed to be axially outward (here, downward) from the first groove 2356. The second groove 2364 is also formed of a respective leading surface 2366 and a trailing surface 2368, where the area of the leading surface 2366 is substantially less than that of the trailing surface 2368. Groove 2364 is formed at an angle to axis A (preferably at right angles to it) and has a radius at its deepest point from axis A which is greater than the radius of an adjacent portion of the inner cavity sidewall 2354. The leading surface 2366 is here chosen to be an annulus at right angles to axis A, while the trailing surface 2368 is chosen to be frustoconical. As in other surface pairs discussed herein, surface pair 2366, 2368 can be chosen to be other than straight in axial profile, such as convexly or concavely curved.

In the illustrated embodiment, the grooves 2356 and 2364 are spaced apart by a surface 2370 which is parallel to axis A. Surface 2370 can be cylindrical or prismatic, for example. First groove 2356 is spaced from opening 2358 by a surface 2372 which is parallel to axis A and whose length in an axial direction is about the same as the axial length of surface 2370. These surfaces 2370, 2372 match up with an axially parallel exterior surface or land 2374 on connector body 2314, spacing apart ridges 2316 and 2320, and an axially parallel exterior surface or land 2376 on connector body 2314, axially forward (here, upward) of ridge 2320.

The connector 2300 also includes an "o-ring" or gasket 2378 made out of an elastomer and which preferably has a rectangular (rather than circular) cross-section. The o-ring or gasket 2378 is sized to closely fit on the exterior surface of the insulated conductor 2302.

An outer axial end wall 2380 of the cap 2350 has an opening 2382 which closely receives the conductor 2302. A section 2383 of the inner sidewall 2354, here shown to be continuous with trailing surface 2368, tapers from the groove 2364 axially outwardly such that its radius gradually decreases. Preferably, at an outer axial end 2385 of the surface 2383, the radius of surface 2383 is chosen to be smaller than an outer radius of the gasket 2378.

Figure 23B:
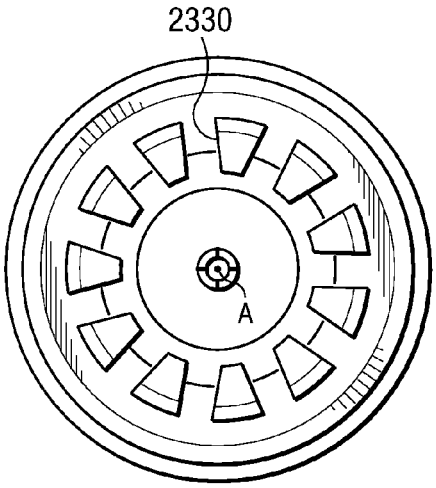
FIG. 23B is a detail of the piercing fingers of the connector seen in FIG. 23A and taken substantially along line 23B-23B of FIG. 23A.
Figure 23A:
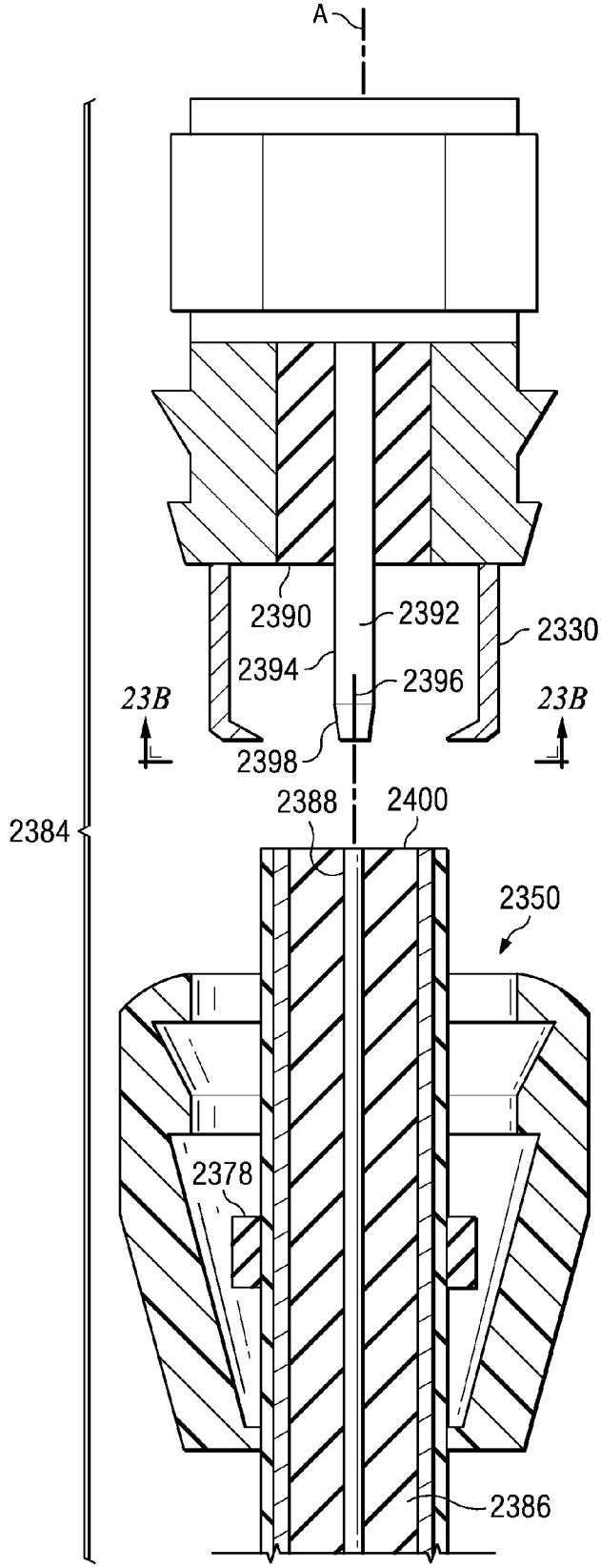
FIG. 23A is an exploded axial sectional view of a connector body and cap according to a twenty-first embodiment of the invention adapted to terminate an unstripped coaxial cable.

FIGS. 23A-B show an alternative embodiment of a coaxial connector 2384 according to the invention is meant to connect to an insulated coaxial conductor 2386 which has an unstripped central conductor 2388. A connector body 2390 of the connector 2384 has a conductive coaxial tube or hollow prong 2392 whose sidewall 2394 may be slit with a slit 2396, as shown. A sharpened end 2398 of the prong 2392 is adapted to penetrate the interconductor insulation 2400 of the conductor 2386, so as to surround and contact a length of the central conductor 2388. Outside of the structure provided to connect to the center conductor 2388, the cap 2384 is identical to cap 2300 illustrated in FIGS. 22A-B.

Figure 24A:
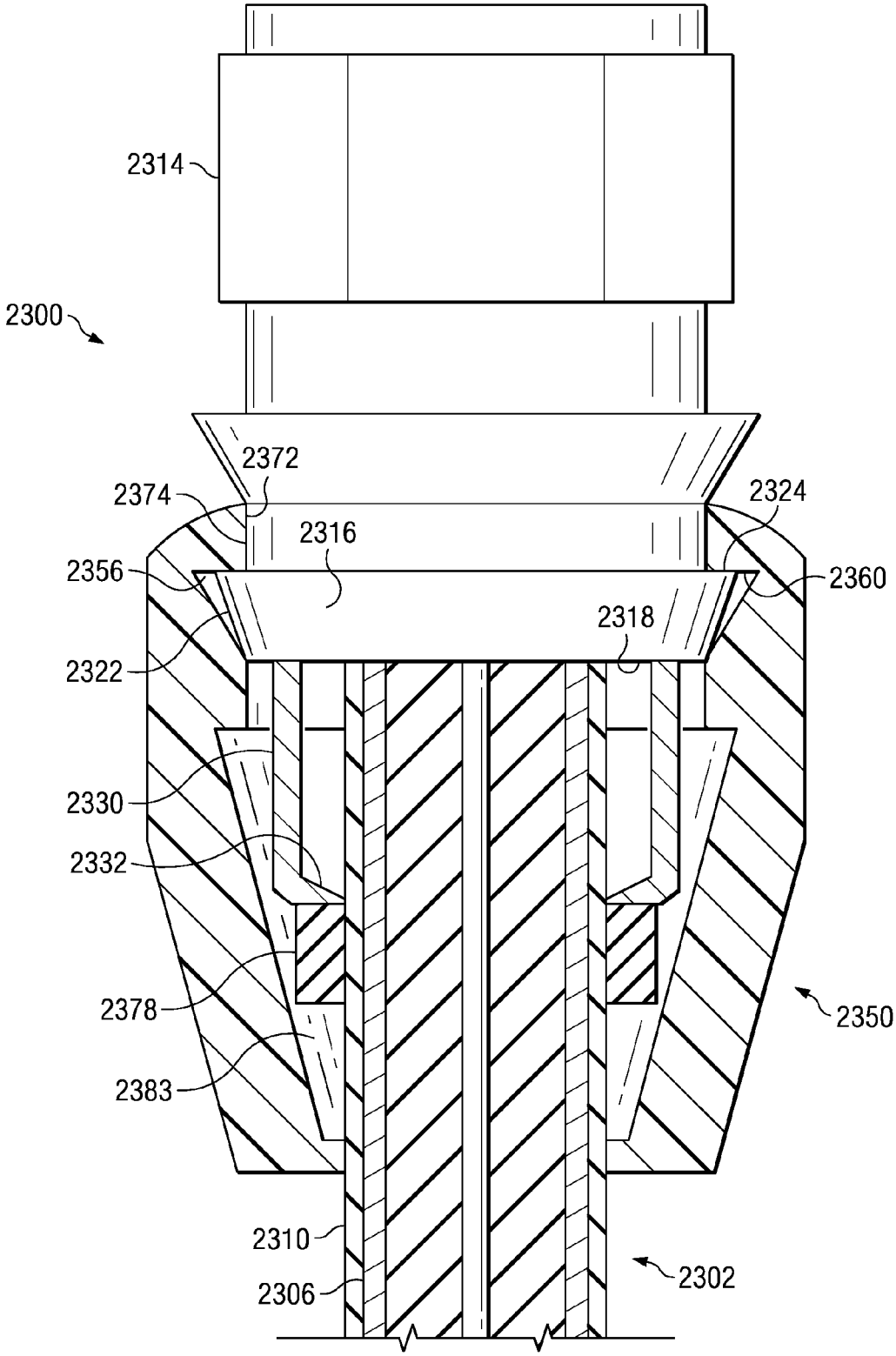
FIGS. 24A and 24B are axial sectional views of a coaxial connector body and cap, respectively showing first and second stages in terminating a coaxial cable.

A first stage of termination of conductor 2302 by connector 2300 is shown in FIG. 24A. At this stage, the conductor 2302 has been inserted until it abuts inner face 2318. In the instance that a conductor 2302 has been provided which has a stripped central conductor 2312, the stripped portion is received within the interior of the connector body 2314. In the instance that an unstripped coaxial conductor 2386 is provided, the connector 2384 of FIGS. 23A-23B is used, wherein the hollow prong 2392 (not shown in this FIGURE) makes connection with the center conductor.

The beginning surface 2372 of the cap 2350 has been snapped over the first ridge 2316, so that axially parallel surface 2372 rests on connector body surface 2374 and first groove 2356 is in registry with the first ridge 2316. The connector 2300 may be provided to the user this way, in a preassembled condition. In this posture the prongs or fingers 2330 have yet to pierce through the outer insulation 2310 of the conductor 2302.

Figure 24B:
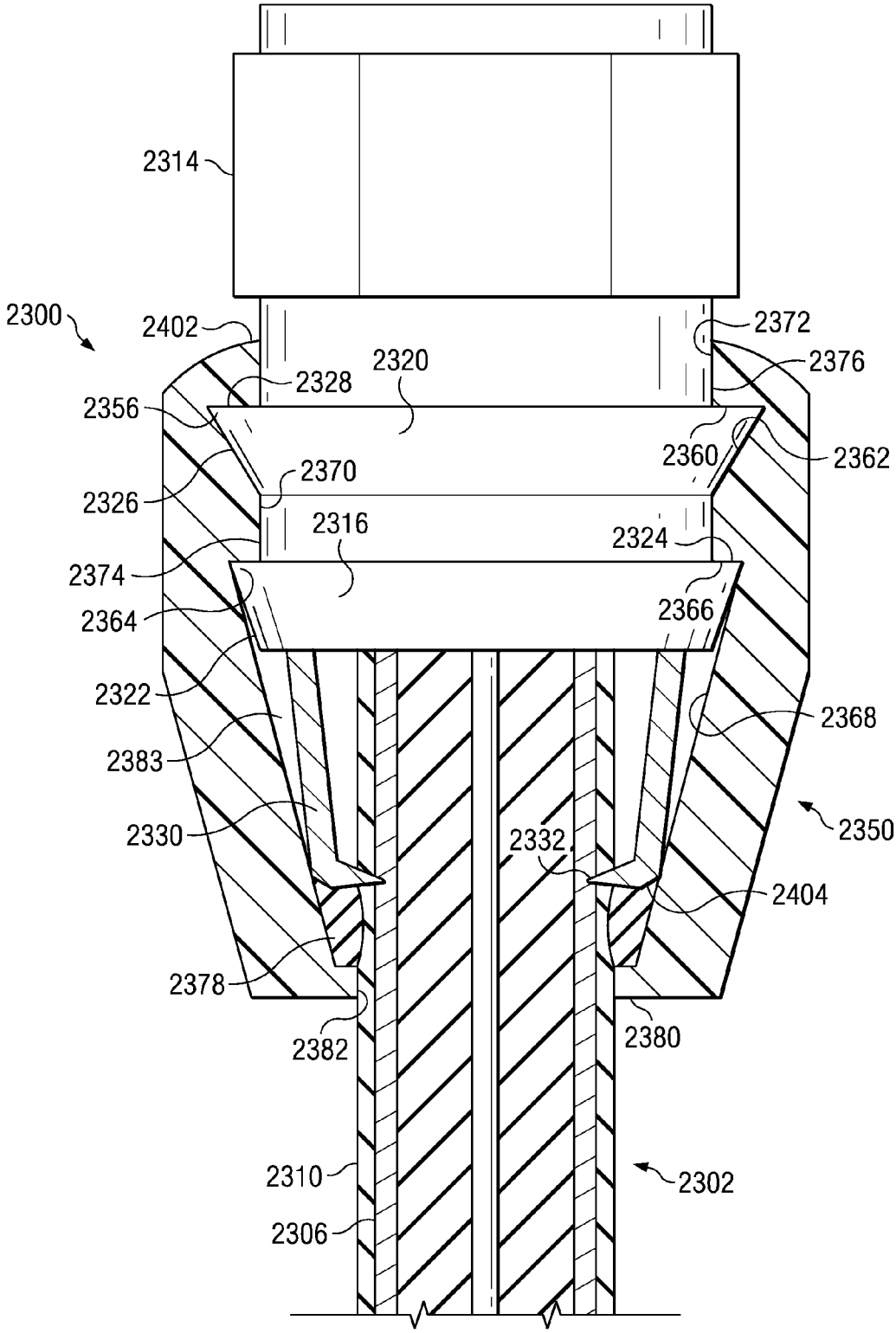

FIG. 24B shows a second, final stage of connection. The cap 2350 has been pushed or compressed, either manually or with the aid of a plier-like tool (not shown), axially inwardly (upward in this FIGURE) until the axial inner end 2402 of the cap 2350 has slid over surface 2362 of the connector body 2314 until end 2402 "snaps" past right annular trailing surface 2360 to rest on land or parallel surface 2372. While this is happening, surface 2374 of the cap 2350 pushes up leading surface 2322 and snaps over connector body trailing surface 2324, to fit onto parallel surface 2370 of the connector body 2314. In this condition, and in the illustrated embodiment, two ridges 2316, 2320 mate with respective grooves 2364, 2356.

Also during this compression step, camming surface 2383 of the cap 2350 pushes tips 2332 of piercing fingers 2330 through the outer insulation 2310 of conductor 2302 and into the conductive sheath 2306. Finally, the elastomeric "o" ring or gasket 2378 is compressed between an axially inward wall of cap end 2380 and an axially outer end or shoulder 2404 of each finger 2330, sealing the cap bore end 2382 to the external surface of insulated conductor 2310.

It should be understood that various features and modifications shown in only one or some of the illustrated embodiments can be easily adapted to the others. Any of the illustrated embodiments can take on a prismatic rather than a cylindrical form, and can even have irregular but substantially axially uniform cross-sections. Any of the illustrated connectors may be formed all of metal or alternatively may be largely constituted by injection-molded plastic. Most of the embodiments are suitable for connecting to uninsulated as well as insulated multistranded wire. All can be furnished in a preassembled condition to end users, or alternatively can be furnished with a cap and physically separate connector body. The connectors according to the invention may be furnished singly or multiply, and may be joined together as might occur where a terminal block or wiring harness has several connector body bores.

O-rings may be furnished in any of the embodiments for sealing an axially outward cap end to the connector body, and/or for sealing the inner bore of the cap to the insulation of the conductor. All illustrated connector bodies may be furnished with only one, or more than two, detenting grooves. All embodiments may be manufactured in end-to-end or Y-conductor splicing forms. The described detenting grooves and ridges can be formed by surfaces other than annuluses and frustoconical surfaces. Connectors may be provided according to the invention in which a groove is provided on the cap and one, two or more detenting ridges are provided on the sidewall of the connector body bore, in mirror image to those described. All embodiments may be provided with discontinuous instead of endless grooves and ridges, and these grooves and ridges may even include several, physically separate segments at each axial position. The conductor supplied with the connector(s) may have its insulation marked along its length to indicate a correct amount of insertion into the connector. These modifications are all within the scope of the disclosed invention.

In summary, different embodiments of a compression snap electrical connector have been shown and described, wherein preferably a ridge or groove on a cap registers with one of at least two grooves or ridges formed in the bore of the connector body. While illustrated embodiments of the present invention have been described and illustrated in the appended drawings, the present invention is not limited thereto but only by the scope and spirit of the appended claims.

I claim:

1. An electrical connector, comprising:

a connector body having a bore with an axis and an open end having a first internal diameter, the bore having a sidewall extending generally axially inwardly from the open end to a bottom of the bore, at least first and second grooves formed in the sidewall, the first groove disposed to be spaced axially inwardly from the open end of the bore and the second groove displaced axially inwardly from the first groove, the first and second grooves generally having diameters which are greater than the first internal diameter;

the second groove having a first surface and a second surface formed axially outwardly from the first surface, the first and second surfaces formed to be generally at an angle to the axis, an area of the first surface being substantially greater than an area of the second surface; and a cap having an inner axial end and an outer axial end and having a cavity from the inner to the outer axial ends for accepting an insulated conductor therethrough, an outer surface of the cap including a general outer surface substantially parallel to the axis and a ridge generally extending radially outwardly therefrom, the ridge having a leading surface and a trailing surface formed axially outwardly from the leading surface, an area of the leading surface being substantially greater than an area of the trailing surface, the leading surface selected from the group consisting of a frustoconical surface, a convexly curved surface, and a concavely curved surface, the leading and trailing surfaces of the ridge further selected from the group consisting of entire leading and trailing surfaces and leading and trailing surfaces interrupted with slits formed through the leading and trailing surfaces;

the ridge of the cap adapted to fit into the first groove of the connector body bore and adapted to fit into the second groove of the connector body bore, the cap advanced from the first groove inwardly down the bore of the connector body so as to seat the leading surface of the ridge with the first surface of the second groove in order to electrically connect to a conductive core of the insulated conductor.

2. The electrical connector of claim 1, wherein the first surface of the second groove and the leading surface of the cap are beveled surfaces.

3. The electrical connector of claim 1, wherein the first and second grooves are endless in a plane orthogonal to the axis.

4. The electrical connector of claim 1, wherein the second surface of the second groove and the trailing surface of the cap are formed to be substantially orthogonal to the axis.

5. The electrical connector of claim 1, wherein the leading surface of the ridge of the cap extends from the inner axial end of the cap axially outwardly therefrom.

6. The electrical connector of claim 1, wherein the sidewall of the bore of the connector body is generally cylindrical.

7. The electrical connector of claim 1, wherein the cap has an axially outward enlargement with a diameter which is larger than the general outer surface of the cap, the connector body having an axially outward face to which the bore of the body axially outwardly extends, the connector further having a sealing elastomeric o-ring compressed between said enlargement and the last said face when the cap is advanced axially inwardly such that the ridge thereof is registered with the second groove of the connector body bore.

8. The electrical connector of claim 1, wherein the connector body has a plurality of bores formed around respective axes, each bore adapted to receive a respective insulated conductor.

9. The electrical connector of claim 8, wherein the cap is a multiconductor cap with a plurality of shafts each radially surrounding a respective cavity for accepting a respective insulated conductor therethrough, each shaft adapted for insertion into a respective one of the plurality of bores in the connector body.

10. The electrical connector of claim 9, wherein the multiconductor cap has an enlargement from which a plurality of the shafts extend, a plurality of the connector body bores opening onto a face of the connector body, the electrical connector further including an elastomeric o-ring for sealing compression between the enlargement and the face, the o-ring surrounding all of the last said plurality of shafts.

11. The electrical connector of claim 8, and further comprising a plurality of caps each having a cavity for accepting a respective insulated conductor therethrough, each cap insertable into a respective bore in the connector body.

12. The electrical connector of claim 11, wherein each of the plurality of caps has an enlargement disposed axially outwardly relative to the connector body bore into which the cap is adapted to be inserted, the last said bore opening onto a face of the connector body, the connector further comprising a plurality of elastomeric o-rings sealingly compressible between respective cap enlargements and the connector body face.

13. The electrical connector of claim 8, wherein each said connector body bore has formed in its respective sidewall more than two grooves, the grooves being axially spaced from each other.

14. The electrical connector of claim 13, wherein said cap has more than two ridges formed on its general outer surface.

15. The electrical connector of claim 8, wherein at least three bores are disposed in a nonplanar array in the connector body.

16. The electrical connector of claim 8, wherein the connector body has first and second opposed sides, at least one of the opposed sides having a plurality of bores, at least one cap provided for each side for insertion into the bores in such side.

17. The electrical connector of claim 8, wherein the connector body has first and second opposed sides, each side having a plurality of bores, each bore adapted to receive a separate insulated conductor.

18. The electrical connector of claim 17, wherein a separate cap is provided for each of the plurality of bores.

19. The electrical connector of claim 17, wherein for at least one of the opposed sides of the connector body, a multiconductor cap is provided, the multiconductor cap having a plurality of spaced-apart shafts for insertion into respective ones of the bores on said at least one side, each shaft radially surrounding a respective cavity for accepting therethrough a respective insulated conductor.

20. The electrical connector of claim 1, wherein the first groove of the connector body includes a first surface and a second surface disposed axially outwardly from the first surface, the first and second surfaces of the first groove being formed at a substantial angle to the axis, a surface area of the first surface of the first groove being substantially greater than a surface area of the second surface of the first groove.

* * * * *